US006454681B1

(12) United States Patent
Brassil et al.

(10) Patent No.: US 6,454,681 B1
(45) Date of Patent: Sep. 24, 2002

(54) HAND REHABILITATION GLOVE

(75) Inventors: Thomas Brassil, 6699 Beadnell Way, #113, San Diego, CA (US) 92117; John M. Brassil, Northbrook, IL (US)

(73) Assignee: Thomas Brassil, San Diego, CA (US)

( * ) Notice: Subject to any disclaimer, the term of this patent is extended or adjusted under 35 U.S.C. 154(b) by 0 days.

(21) Appl. No.: 09/475,793

(22) Filed: Dec. 30, 1999

Related U.S. Application Data

(63) Continuation-in-part of application No. 09/197,035, filed on Nov. 21, 1998, now abandoned.
(60) Provisional application No. 60/070,380, filed on Jan. 5, 1998.

(51) Int. Cl.[7] ..... A63B 23/16
(52) U.S. Cl. ..... 482/49; 482/47
(58) Field of Search ..... 600/587, 595; 601/40; 482/47–49, 121, 122, 124, 44; 602/21–22; 2/161.1, 159; 294/25

(56) References Cited

U.S. PATENT DOCUMENTS

| | | | | |
|---|---|---|---|---|
| 940,744 | A | | 11/1909 | Smith |
| 1,640,004 | A | | 8/1927 | Lundblad |
| 2,738,190 | A | | 3/1956 | Tureaud |
| 3,347,547 | A | | 10/1967 | Hynes |
| 3,413,243 | A | | 11/1968 | Griffin |
| 3,547,112 | A | | 12/1970 | Courtney |
| 3,670,574 | A | | 6/1972 | Edwards |
| 3,774,242 | A | | 11/1973 | Owen |
| 3,944,220 | A | | 3/1976 | Fasano |
| 4,089,070 | A | | 5/1978 | Cherry |
| 4,362,737 | A | | 12/1982 | Schafer |
| 4,405,616 | A | | 9/1983 | Rajadhyaksha |
| 4,414,537 | A | | 11/1983 | Grimes |
| 4,542,291 | A | | 9/1985 | Zimmerman |
| 4,567,065 | A | | 1/1986 | Schniederman |
| 4,675,914 | A | | 6/1987 | Mitchell |
| 4,796,306 | A | | 1/1989 | Mitchell |
| 4,830,360 | A | | 5/1989 | Carr |
| 4,907,574 | A | * | 3/1990 | Hollerbach ..... 128/64 |
| 5,280,265 | A | | 1/1994 | Kramer |
| 5,297,541 | A | * | 3/1994 | Hensey ..... 601/40 |
| 5,345,609 | A | * | 9/1994 | Fabry et al. ..... 2/20 |
| 5,409,447 | A | | 4/1995 | Wedge, Jr. |
| 5,429,140 | A | | 7/1995 | Burdea et al. |
| 5,453,064 | A | * | 9/1995 | Williams, Jr. ..... 482/47 |
| 5,527,244 | A | | 6/1996 | Waller |
| D374,469 | S | | 10/1996 | Barra |
| 5,631,861 | A | * | 5/1997 | Kramer ..... 364/406 |
| 5,688,233 | A | | 11/1997 | Hofmann |
| 5,715,834 | A | * | 2/1998 | Bergamasco et al. ..... 128/82 |
| 5,765,228 | A | | 6/1998 | Bieling |
| 5,769,801 | A | * | 6/1998 | Tumey et al. ..... 601/152 |
| 6,055,669 | A | * | 5/2000 | Albert ..... 2/161.1 |
| 6,231,525 | B1 | | 5/2001 | Paske |
| 6,264,621 | B1 | | 7/2001 | Paske |

FOREIGN PATENT DOCUMENTS

CA 2200648 A1 9/1998

* cited by examiner

*Primary Examiner*—Justine R. Yu
(74) *Attorney, Agent, or Firm*—Fitch, Even, Tabin & Flannery

(57) ABSTRACT

An exercise and therapy hand device consists of a glove for receiving a hand. The glove includes a palm portion, one or more finger portions for receiving a finger, a back portion, and a compressible substance that is coupled to the palm portion. Also included in the glove are one or more elastic members that span from the compressible substance to respective ones of the one or more finger portions. The compressible substance exercises the muscles of the hand that control the closing of the hand, while the one or more elastic members exercise the muscles of the hand that control the opening of the hand.

44 Claims, 16 Drawing Sheets

HAND REHABILITATION GLOVE

This is a Continuation-in-Part of U.S. patent application Ser. No. 09/197,035, entitled HAND REHABILITATION GLOVE, filed Nov. 21, 1998, now abandoned, which claims priority from U.S. Provisional Application No. 60/070,380, entitled HAND REHABILITATION GLOVE, filed Jan. 5, 1998, all of which are incorporated herein by reference.

BACKGROUND OF THE INVENTION

The present invention relates to exercise and therapy devices, and more particularly to exercise and therapy devices for hands and fingers. Even more particularly, the present invention relates to a hand and finger exercise and therapy glove and system.

Typical methods of exercising and rehabilitating hands and fingers include devices such as a putty material, a rubber ball, or a "coiled-spring" hand grip that is squeezed with the fingers and hand. Examples of such devices are shown in U.S. Pat. No. 3,944,220 issued to Fasano in 1976, U.S. Pat. No. 4,675,914 issued to Mitchell in 1997, U.S. Pat. No. 4,796,306 issued to Mitchell in 1989, U.S. Pat. No. 3,774,242 issued to Owen in 1993, U.S. Pat. No. 4,830,360 issued to Carr in 1989, and U.S. Pat. No. 5,765,228 issued to Bieling in 1994.

Other glove devices include the conforming grip glove of U.S. Pat. No. 4,089,070 issued to Cherry in 1978. The conforming grip glove has a squeezable substance attached to the palm of the glove and conforming generally to the palm of the glove, but it is designed to grip an object, not to exercise the hand. In 1996, U.S. Pat. No. 5,527,244 was granted to Waller, entitled "BIDIRECTIONAL EXERCISE GLOVE". Waller's design exercises the hand and the fingers through a more complete range of motion. Rods along the inside and back of the fingers/hand impose pressure from both opening and closing the hand. Disadvantageously, concentrated pressure from rods against the digits (i.e. fingers), knuckles, and hand of the patient would irritate an already painful condition, and discourage therapy.

SUMMARY OF THE INVENTION

The present invention advantageously addresses the needs above as well as other needs by providing a hand rehabilitation device that imposes pressure on the hand and fingers during both opening and closing of the hand while minimizing the stress on the joints of the hand, promoting balanced neuromuscular development; thus, leading to exercise sessions of longer duration and increasing intensity.

In one embodiment, the invention can be characterized as a hand exercise device comprising a glove for receiving a hand. The glove includes a palm portion, one or more finger portions for receiving a finger, a back portion and one or more elastic members spanning from the palm portion to respective ones of the one or more finger portions.

In another embodiment, the invention can be characterized as a hand exercise device comprising a glove for receiving a hand. The glove includes a palm portion, one or more finger portions for receiving a finger, a back portion, a compressible substance coupled to the palm portion, one or more chambers formed within the compressible substance, and a material contained within the one or more chambers. The material may be a gas, a fluid, or a gel.

In yet another embodiment, the invention can be characterized as a hand exercise device comprising a glove for receiving a hand. The glove includes a palm portion, one or more finger portions for receiving a finger, a back portion, and a compressible substance that is coupled to the palm portion. Also included in the glove are one or more elastic members that span from the compressible substance to respective ones of the one or more finger portions.

In a further embodiment, the invention can be characterized as a hand therapy system comprising a glove that includes a compressible substance coupled to a palm portion that provides resistance to the closing motion of the hand. Also the glove includes one or more elastic members that span from the compressible substance to respective ones of one or more finger portions, such that the one or more elastic members provide resistance to the opening of the hand. The glove also includes a means for providing a signal proportional to the movement of the digits of the hand while opening and closing the hand and a means for providing a signal proportional to the pressure applied by one or more of the digits of the hand on the compressible substance. The hand therapy system further includes a controller that is coupled to the means for providing a signal proportional to the movement and the means for providing a signal proportional to the pressure and also a computer coupled to the controller via a computer link.

In another further embodiment, the invention can be characterized as a method of hand therapy comprising the following steps including providing a glove that includes a compressible substance coupled to a palm portion for providing resistance to the closing motion of the hand and one or more elastic members that span from the compressible substance to respective ones of one or more finger portions, such that the one or more elastic members provide resistance to the opening of the hand. Other steps included are determining an estimate of the displacement of one or more digits of a hand during opening and closing of the hand and determining an estimate of the pressure exerted on a compressible substance by the one or more digits during the closing of the hand.

In a subsequent embodiment, the invention can be characterized as a method of making a hand exercise device comprising the steps of forming a glove including a palm portion, one or more finger portions for receiving a finger and a back portion; forming a compressible substance; coupling the compressible substance to the palm portion; forming one or more elastic members; and spanning and coupling the respective ones of the one or more elastic members from the compressible substance to respective ones of one or more finger portions.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE PREFERRED EMBODIMENTS

The following description of the presently contemplated best mode of practicing the invention is not to be taken in a limiting sense, but is made merely for the purpose of describing the general principles of the invention. The scope of the invention should be determined with reference to the claims.

Rehabilitation Glove

Figure 1:
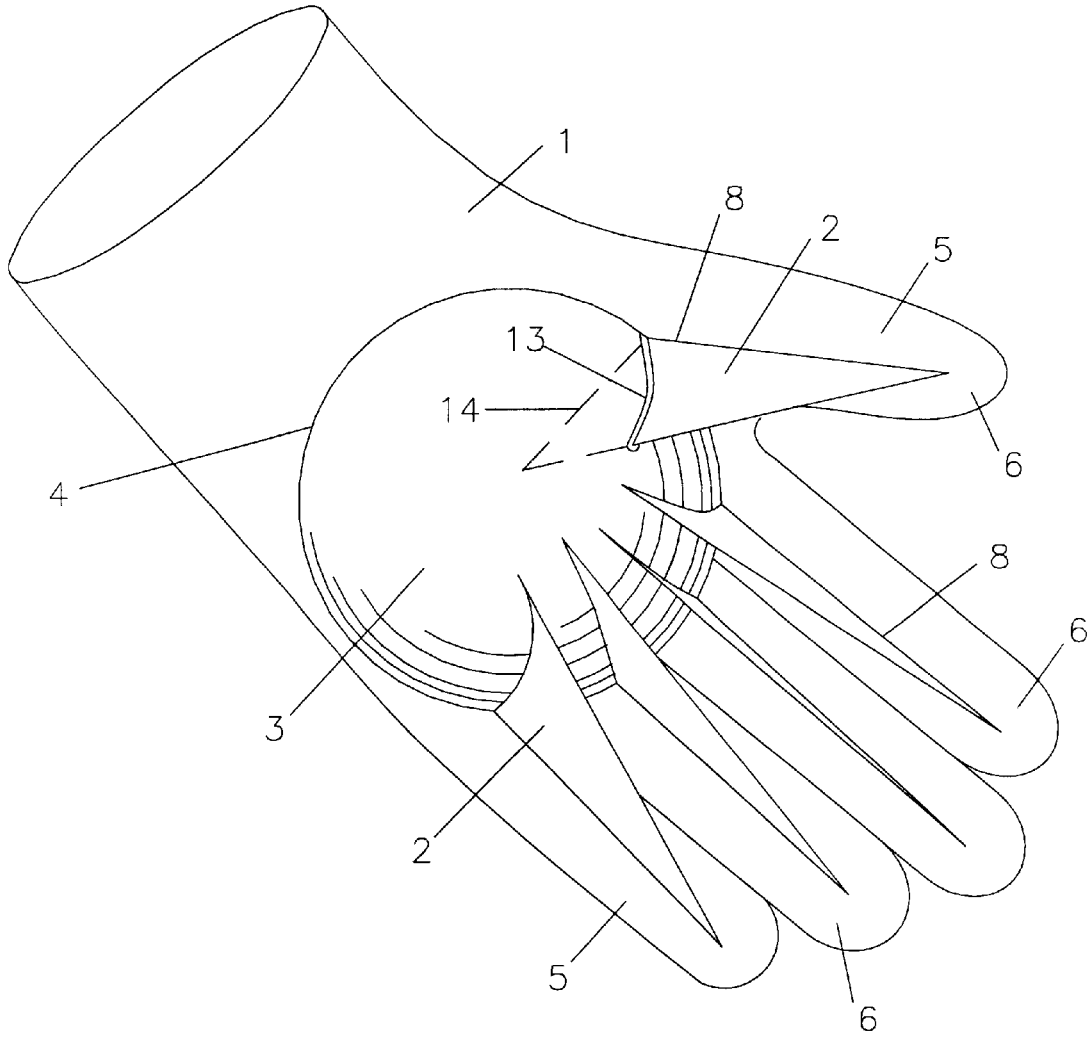
FIG. 1 is a view of the exercise and therapy hand device in accordance with one embodiment of the present invention.

Referring first to FIG. 1, a view of the hand exercise device (also referred to as a hand rehabilitation device or glove) in accordance with one embodiment of the present invention is shown. Included are a glove 1 having generally: a palm portion 4, finger portions 5, a fingerprint area 6 of the finger portions 5, and a back portion (not shown in FIG. 1, see FIG. 2); elastic members 2; and a compressible substance 3.

The palm portion 4, the back portion, and the finger portions 5 generally form the glove 1. The glove 1 is flexible and is made from one continuous material (such as cloth, leather, neoprene, lycra, or rubber) as commonly understood in the art. Each elastic member 2 typically forms a "web" that spans or extends from the fingerprint area 6 of each of the finger portions 5 to the compressible substance 3 (also referred to as the "squeezable substance 3"). The compressible substance 3 is attached to the palm portion 4 of the glove 1.

The compressible substance 3 is typically shaped as a ball, oval, or generally a spheroid shape. It should be comprised of such a material that the compressible substance 3 (i.e. a spongy material) can be physically compressed or squeezed by the hand of the user within the glove 1 yet generally return to its original shape once the pressure is removed, such as the rubber ball and putty devices as known in the art. Thus, in use, the compressible substance provides resistance to the closing motion of the hand. For example, the compressible substance may be made of rubber, putty, gel, PVC, silicone, neoprene, lycra, cloth, latex, or other suitable material. The compressibility and size of the compressible substance 3 can be altered in different gloves to increase or decrease the difficulty in operating the device. The compressible substance 3 is attached to the palm portion 4 of the glove 1, usually being sewn or glued directly to the palm portion 4. Many other attachment means may be devised by one of ordinary skill in the art.

Figure 4:
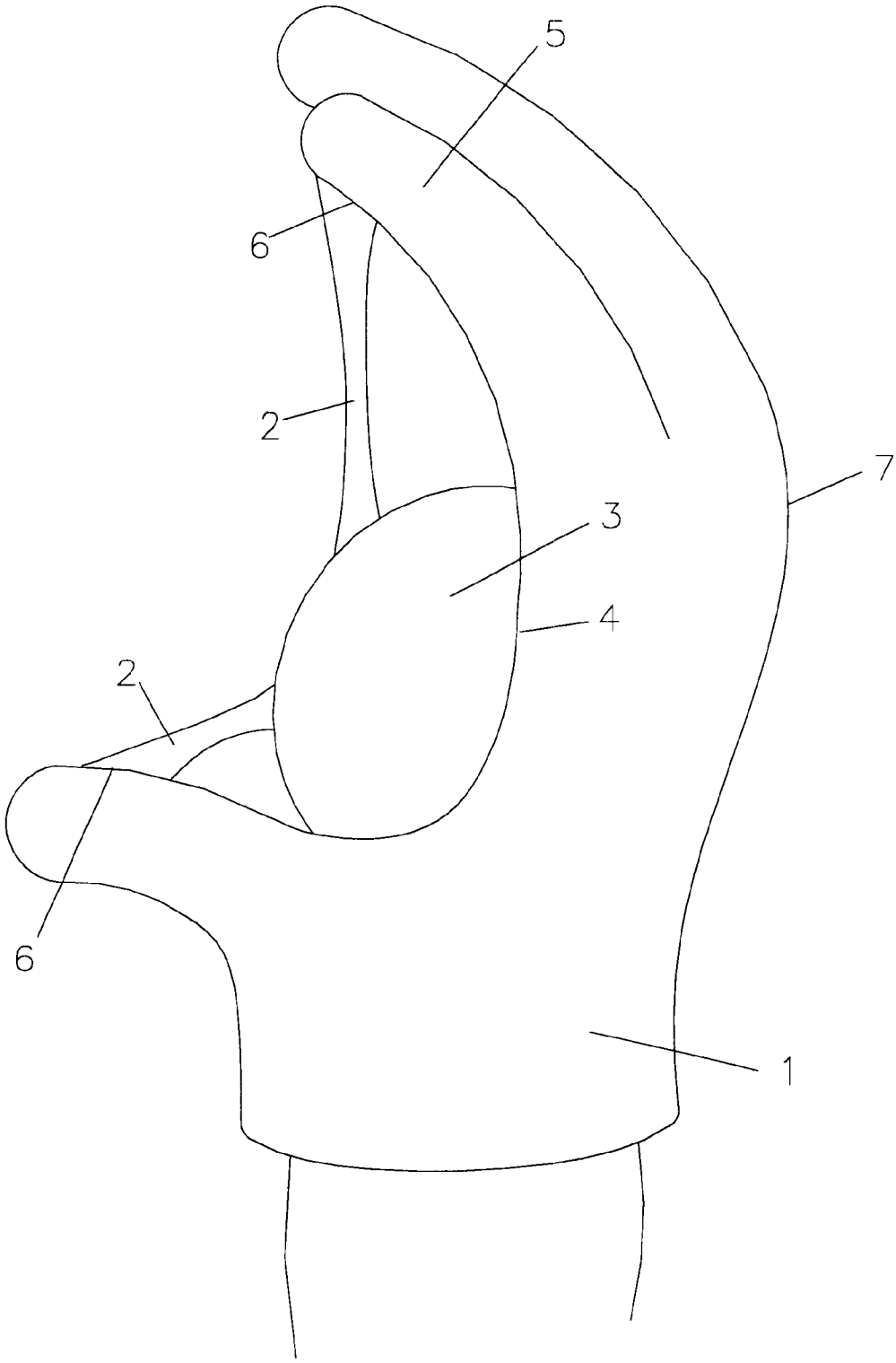
FIG. 4 is a view of another embodiment of the present invention in which the elastic members are shown as bands.

The elastic members 2 may be made from such materials as lycra, neoprene, rubber, latex, or other elastic materials known in the art. The elastic members 2 take the form of a "web" as shown in FIG. 1 that attaches to the fingerprint area 6 of the finger portions 5 and to the compressible substance 3. Thus, the elastic members span from the compressible substance 3 to the finger portions 5 at the finger print area 6 and also couple the compressible substance 3 to the respective finger portions 5. Therefore, the elastic members 2 provide resistance to the opening motion of the hand, without applying undue pressure to the joints of the fingers during opening. Furthermore, the elastic members 2 may also be attached to the finger portion 5 along edge 8 of the elastic member 2. Note that throughout the specification, when referring to "fingers" or "finger" portions, such terms are meant to include all digits of the hand including the thumb, e.g. a finger portion may be for receiving the thumb. Alternatively, the elastic member 2 may be formed as a "band", which is illustrated in FIG. 4, that attaches to the finger portion 5 only at the fingerprint area 6. The "band" embodiment is further described with reference to FIG. 4.

The elastic members 2 may be attached to the fingerprint area 6 in a variety of ways. The elastic member 2 may be sewn into the fingerprint area 6 and also sewn into the compressible substance 3 or may be glued into position. Furthermore, the elastic member 2 may be sewn or glued to the exterior or interior surface of the finger portion 5 and compressible substance 3. Alternatively, the entire glove 1 may be formed out of a latex or synthetic latex (like a surgical glove), such that the glove is molded to include the elastic members 2 in the form of "webs" or "bands" depending on the embodiment. This would provide a seamless, single mold, mass produced latex design that could be manufactured at a low cost that could be disposable after use. Such a molding process is well known in the art, thus no further explanation is needed. Additionally, during the molding process, the compressible substance 3 may be made attachable to the glove by forming a "pocket" or "encapsulant" in the palm portion 4 of the glove 1. Thus, the compressible substance 3 could be injected or inserted into the "pocket". This is further discussed with reference to FIG. 5.

Each elastic member 2 is attached to the compressible substance 3 or in another embodiment, may be attached directly to the palm portion 4, in which case "slits" 13 are formed in the compressible substance 3 which the elastic members 2 pass though and then span to and attach to the fingerprint area 6 of the finger portion 5. Such slits 13 run through the depth of the compressible substance 3. In FIG. 1, the dashed line 14 represents an elastic member 2 extended through the compressible substance 3 and attached to the palm portion 4 directly. Note that only one of the slits 13 is shown, although in this embodiment, all of the elastic members 2 extend through respective slits in the compressible substance 3. Note also that the slit 13 and the dashed line 14 only apply to this alternative embodiment described and not the standard embodiment of FIG. 1 in which the elastic members 2 couple and attach directly to the compressible substance 3 itself Thus, while forming this alternative embodiment, the elastic members 2 are first attached to the palm portion 4 of the glove 1, then the elastic members 2 are placed (or slid) through slits 13 in the compressible substance 3 as the compressible substance 3 is positioned and attached to the palm portion 4 of the glove 1. Then, the elastic members 2 are attached to the fingerprint area 6 of the finger portions 5. Alternatively, the elastic members are already attached to the finger portions 5 when the compressible substance 3 is positioned and attached to the palm portion 4.

An additional feature of the embodiment as shown in FIG. 1 is that the interior surface of the glove 1 (not shown) may be coated with a topical medication that will synergistically enhance therapy during use of the hand exercise device. In use, the repetitious opening and closing of the hand will alternate between stretching and relaxing the skin, which in turn will open and close the pores. The heat generated from both the friction of the glove against the skin, and the exercise, will be retained inside the glove and dilate the pores. The opening and closing pores, combined with a well fitting or snugly fitting glove will produce a massaging effect, pressing the medication into the pores. This will enhance medication absorption into the skin of the user's hand during use of the hand exercise device. Analgesic, anti-inflammatory, or pain relieving medications may be used which will enable patients hindered by painful conditions to comfortably perform more repetitions against greater resistance. As such, the hand exercise device incorporating a medication on the interior surface of the glove will synergistically improve therapy since the medication may be absorbed quickly into the desired areas and allow the user to overcome painful conditions, at least to the extent to temporarily exercise the hand (e.g. if analgesics or pain relieving medications are being used).

In disposable designs, the medication option is advantageous, since the residue medication and sweat within the hand exercise device does not need to be cleaned out, as the hand exercise device can be disposed of following use. Such hand exercise devices may be manufactured and mass produced including an appropriate dosage of a desired medication.

Furthermore, in addition to medications, other supplements may be incorporated or coated onto the inner surface of the hand exercise device. Examples of such supplements are Glucosomine and chrondroitin sulfate, which have been found to be helpful in treating osteoarthritis, and are described in pages 29–52 of "The Arthritis Cure" by Theodosakis, Adderly and Fox, 1997, which is incorporated herein by reference. These supplements may also be used with carriers or penetration enhancing agents, such as those shown in U.S. Pat. No. 4,362,737, issued Dec. 7, 1982 to Schafer, and U.S. Pat. No. 4,405,616 issued Sep. 20, 1983 to Rajadhyaksha, which are incorporated herein by reference.

Alternatively, other methods of enhancing the absorption of medication into the skin of the user during use may be employed, such as coupling electrodes (not shown) to the user's hand within the hand exercise device or glove 1 and providing a low level pulsed electric field to the hand of the user. As such, the pulsed electric field allows materials, such as medications and supplements, to better penetrate the outer layer of the skin; thus, enhancing the absorption of the medication or supplement into the skin. Such techniques are known in the art and are referred to as "electroporation" or "electroincorporation". These techniques and apparatus for accomplishing the techniques are described, for example, in U.S. Pat. No. 5,688,233, issued Nov. 18, 1997 to Hofmann, et al. entitled "ELECTROINCORPORATION ENHANCED TRANSDERMAL DELIVERY OF MOLECULES"; which is incorporated herein by reference. Thus, advantageously, the absorption of medication into the skin of the user may be accelerated using electroporation techniques since the user may only use the hand exercise device for a short period of time. Furthermore, as known and described in the '233 patent, the effects of the application of a pulsed electric field may last for up to a minute after treatment. Thus, a user could be subjected to electroporation prior to using a medicated glove and still receive the benefit of the electroporation treatment.

Other alternative embodiments of the hand exercise device including a glove containing only the compressible substance 3 and not the elastic members 2 for isolating and exercising the muscles involved in the closing of the hand, without exercising the muscles controlling the opening of the hand. Another alternative embodiment includes only the elastic members 2 and not the compressible substance 3, such that the muscles for opening the hand may be isolated and exercised, without exercising the muscles controlling the closing of the hand.

Figure 2:
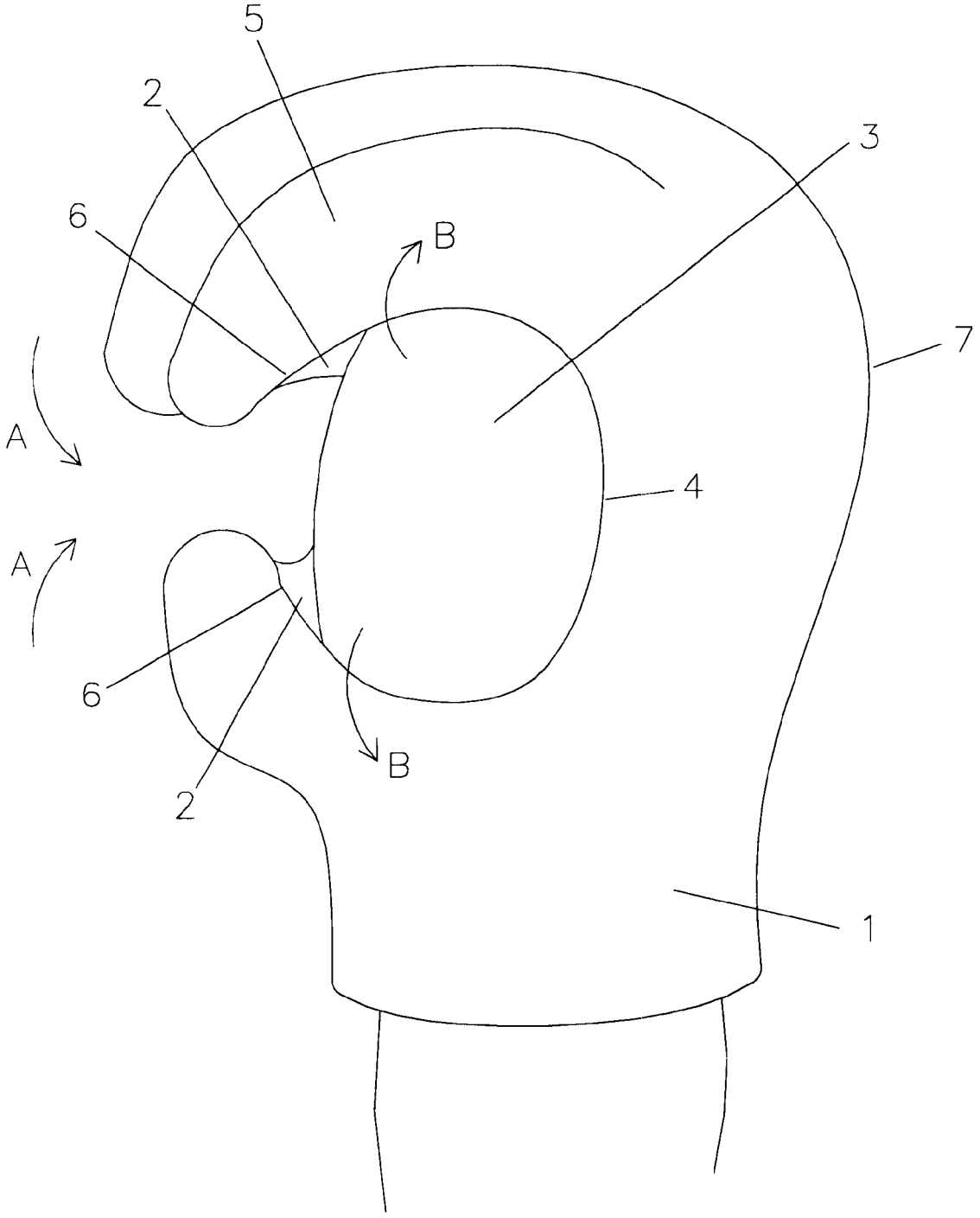
FIG. 2 is a view of the exercise and therapy hand device of FIG. 1 operating during "closing" of the hand.

Referring next to FIG. 2, a view of the hand exercise device of FIG. 1 operating during the "closing" of the hand is shown. In operation, when the user is attempting to "close" the hand, indicated by arrows "A", the user applies pressure to the compressible substance 3 which then compresses and provides resistance, shown as arrow "B". The compressible substance 3 resists the compression, similar to the rubber balls or putty known in the art. The strength of the compressible substance 3 may be varied in order to increase the exercise. The elastic members 2 simply flex in toward the compressible substance 3 and do not affect the compressibility (or squeezability) of the compressible substance 3. This aspect is unique in that the compressible substance is actually attached to the palm portion of the glove as opposed to conventional devices wherein the rubber ball or compressible object is "free standing" and does not require a glove for use. Furthermore, within the same device, both a means for exercising the muscles when closing and when opening the hand is provided.

Figure 3:
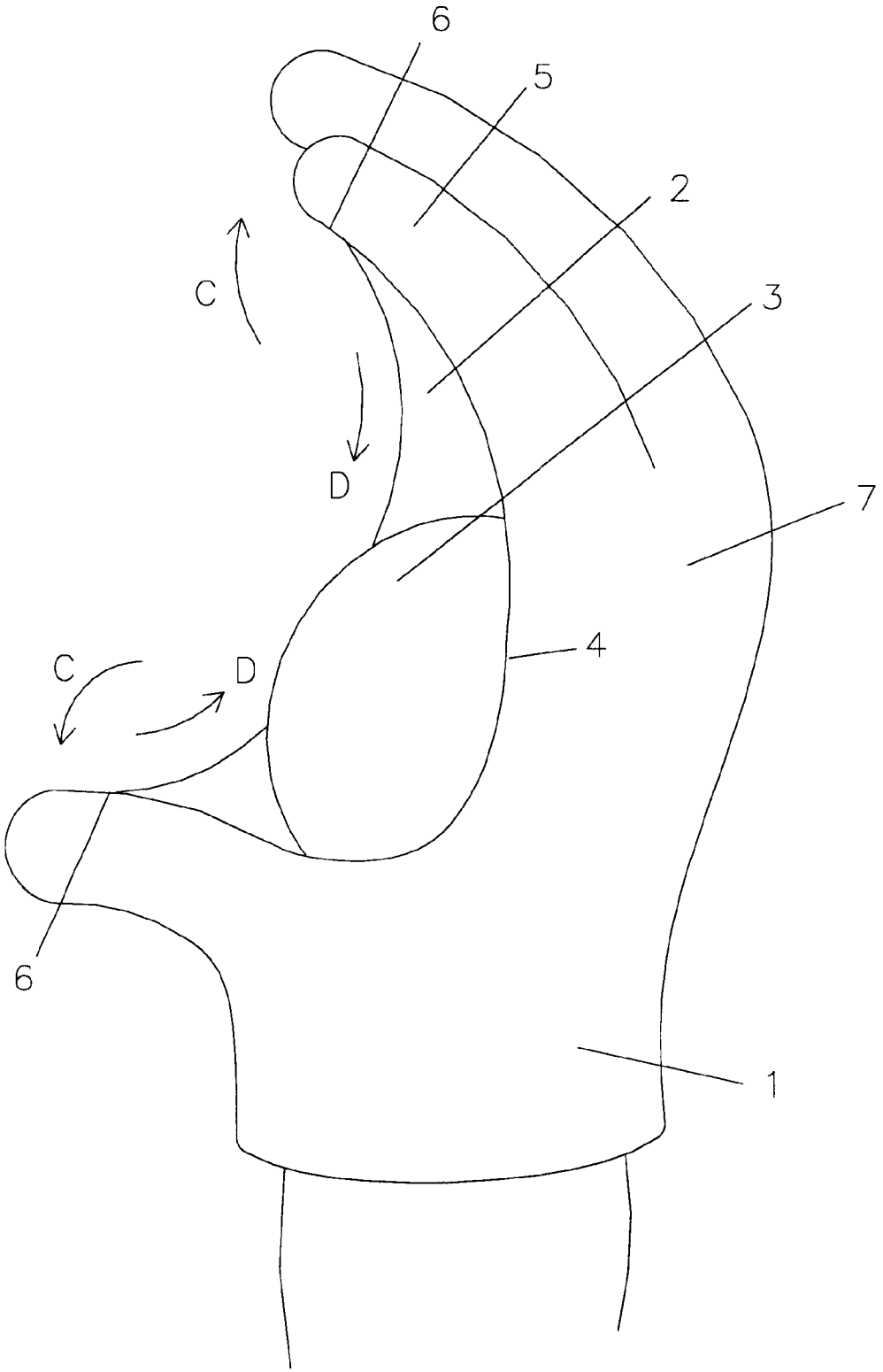
FIG. 3 is a view of the exercise and therapy hand device of FIG. 1 operating during "opening" of the hand.

Referring next to FIG. 3, a view of the hand exercise device of FIG. 1 operating during "opening" of the hand is shown. During opening of the hand, shown by arrows "C", the elastic members 2 provide a resistance to this movement indicated by arrows "D". The elastic members 2 (either webs or bands) are designed to have a specified amount of resistive force ("D"). This can be achieved by varying the thickness, strength and length of the elastic members 2. Advantageously, a specified amount of resistive force is created on each finger and the hand during opening of the hand. Thus, the muscles that open the hand will be exercised in a manner which provides little or no stress on the joints of the fingers. Additionally, to meet specific patient needs, the specified resistive force may be different on different elastic members 2, such that different fingers (digits) will exercise differently, e.g. certain fingers may need to be strengthened more than others. Also, different hand exercise devices having different elastic properties (i.e. the compressible substance 3 is more or less compressible and the elastic members 2 provide more or less resistive force) may be used as the user progresses in hand and finger strength. The user may also use different hand exercise devices having different strengths on different hands (i.e. left and right).

Advantageously, the present invention is a departure from the prior art in that it provides a very comfortable way in which to exercise the hand and fingers in a more complete motion during both the opening and closing of the hand. Rods (see U.S. Pat. No. 5,527,244), or other uncomfortable mechanical devices designed to add tension in the fingers while opening and closing, that add stress and pressure to the joints and fingers during use, are not used. In contrast, simple, elastic materials that are easy and cost effective to manufacture are used; thus, the pressure and subsequent irritation caused by such rods on the fingers, knuckles, and hand of the user are avoided. The hand exercise device also disperses pressure imposed upon the hand and fingers during both the opening and closing of the fingers, instead of concentrating the pressure in certain locations of the hand; thus, promoting thorough and balanced neuromuscular development. The hand exercise device may be easily designed to have many different elastic characteristics, i.e. different tensions, and may even allow different elastic characteristics for differing digits (fingers).

Referring next to FIG. 4, a view of another embodiment of the hand exercise device of FIG. 1 is shown operating during "opening" of the hand. In this embodiment, the elastic members 2 are "bands" instead of "webs", as shown in FIG. 1. The elastic members 2, again extend from the fingerprint area 6 of the finger portions 5 and attach to the compressible substance 3 (at either the exterior of interior surface), similar to that as described above, e.g. sewn, glued, etc., or alternatively attached to the palm portion 4 itself through slits (see the alternative embodiment described in FIG. 1) in the compressible substance 3, or attached to a pocket formed in the palm portion 4 of the glove 1. Note that the bands of elastic material (i.e. elastic members 2) only attach at the compressible substance 3 and the fingerprint area 6, not along the edge of the finger, as the "web" embodiment may so attach. Again, the thickness, strength, and length of the bands of elastic material may be altered in order to create different resistive forces when opening the hand depending on an individual's needs.

Figure 5:
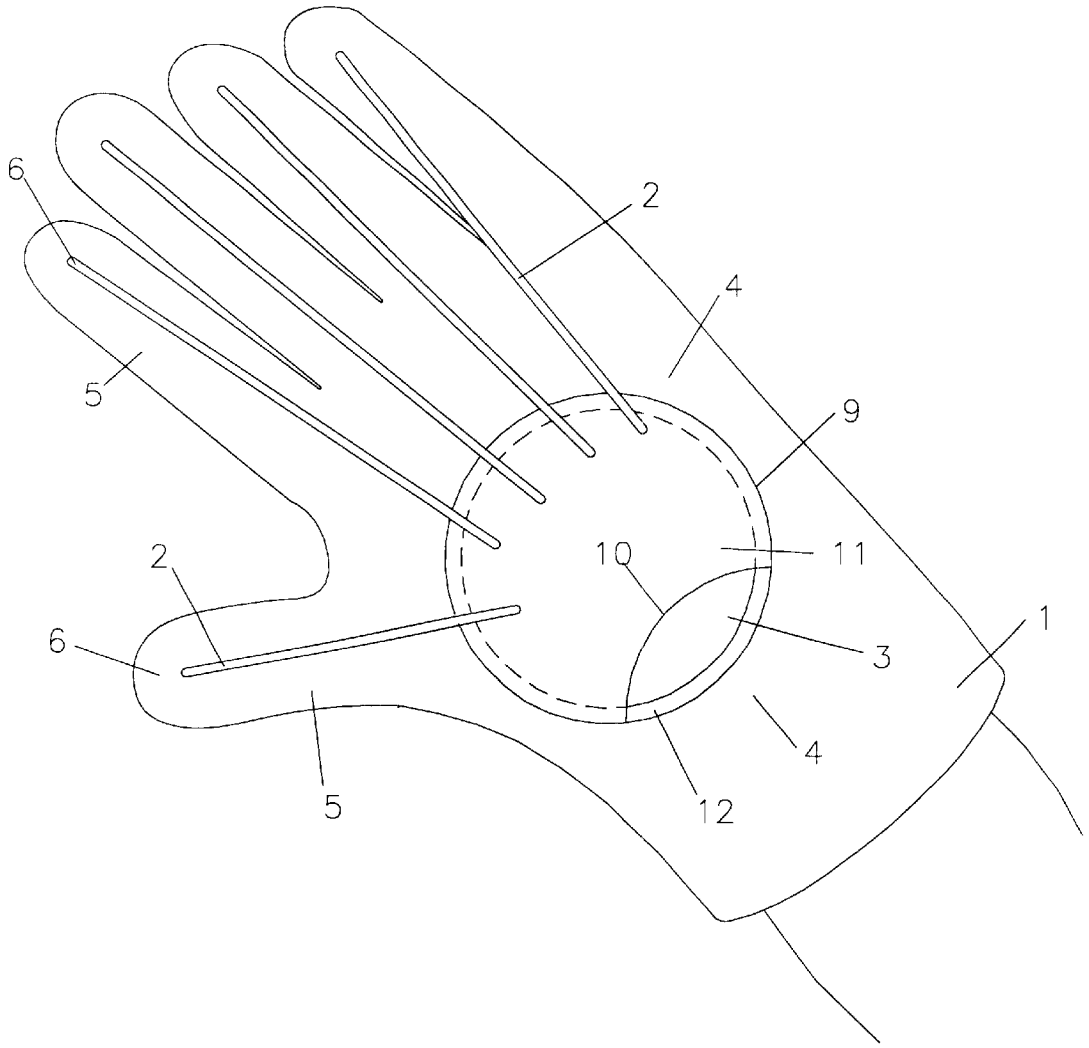
FIG. 5 is a view is another embodiment of the exercise and hand therapy device having a pocket formed therein for receipt of a compressible substance.

Referring next to FIG. 5, a view is shown of the hand exercise device having a pocket 9 formed in the palm portion 4 of the glove 1. In this embodiment, the compressible substance 3 is fit within the pocket (which can also be referred to as the encapsulant). The pocket 9 may be an integral part of the glove 1, such as where the glove is a molded latex or synthetic latex seamless construction. Thus, the compressible substance 3, which is made of a generally compressible material as described above is inserted or injected into the pocket 9. Alternatively, the pocket 9 could be formed from other materials, such as lycra, neoprene, cloth, or rubber, etc., and glued or sewn onto the palm portion 4 of the glove 1.

Additionally, the pocket could have a cover flap 11 that folds over the compressible substance 3 and forms the pocket 9 for containing the compressible substance 3. The pocket may contain a hole formed between the cover flap 11 at a flap edge 10 and the pocket bottom panel 12 (which may simply be the palm portion 4 of the glove 1. The compressible substance 3 could then be either sealed within the pocket 9 as an encapsulated compressible substance or made removable through the hole left in the pocket 9. By making the compressible substance 3 removable, the compressible substance 3 may be interchanged with other compressible substances 3 having different degrees of compressibility or elastic characteristics (i.e. "softer" or "harder" compressible substances).

In other embodiments, the pocket could be sealed and function as a balloon-like structure that attached to the palm portion 4 of the glove 1. Thus, the encapsulant or pocket 9 could be pumped full of air (or fluid) at a certain pressure to form the compressible substance 3. This is described in more detail below. Thus, the air-filled pocket 9 (which functions as the compressible substance 3) could be a balloon-like latex capsule and would resist the complete closing of the hand and, therefore, exercise the hand accordingly.

Additionally, the subject matter described herein is related to Patent Application Ser. No. 09/197,035, entitled HAND REHABILITATION GLOVE, of Brassil, filed Sep. 10, 1999 which is incorporated herein by reference.

Hand Therapy System and Diagnostic Glove

Figure 6:
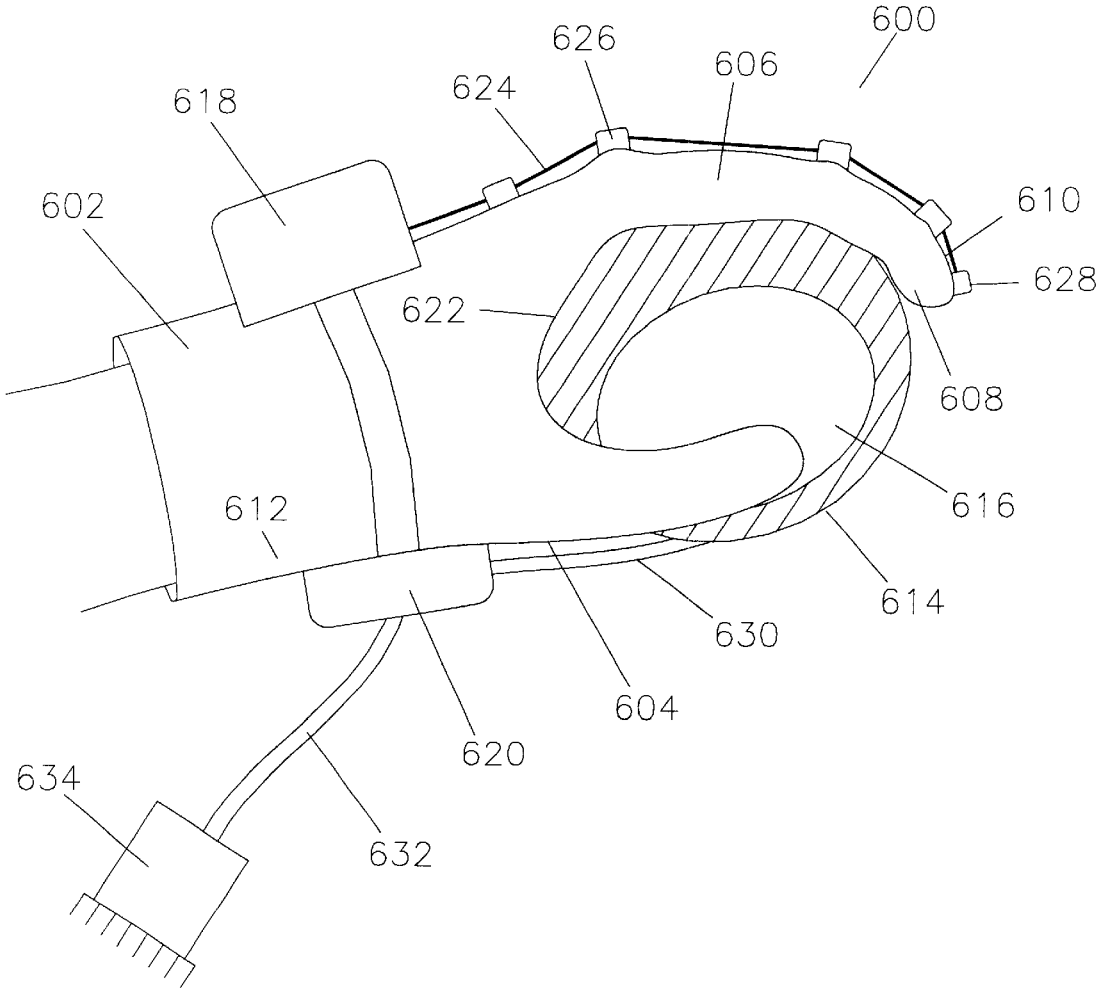
FIG. 6 is a palm-down side view of another embodiment of the hand exercise device which is referred to as a diagnostic glove.

Referring next to FIG. 6, a palm-down side view is shown of a diagnostic glove in accordance with another embodiment of the present invention. Shown are the diagnostic glove 600 (also referred to as a hand exercise device or hand rehabilitation glove). The diagnostic glove 600 includes the back portion 602, the palm portion 604, the finger portions 606, the fingerprint area 608, fingernail portion 610, wrist portion 612, a compressible substance 614 that has a chamber 616 located within the compressible substance 614, a displacement transducer module 618, a compressor/pressure transducer module 620, a thermal transducer 622, lines 624, line guides 626, anchor 628, fill tube 630, output line 632, and a computer interface 634.

The diagnostic glove 600 is very similar to the embodiments described above, with the addition of measuring devices or transducers so that a user can determine an estimate of the amount of force or pressure exerted on the compressible substance 614 (using the compressor/pressure transducer module 620), the distance that each digit (or finger) has traveled while both opening and closing the hand (using the displacement transducer module 618), the heat generated during the exercise or rehabilitation of the hand (using the thermal transducer 622), the amount of repetitions and the speed of such repetitions.

The displacement transducer module 618 is affixed to back portion 602 of the diagnostic glove 600 and has lines 624 extending therefrom. The lines 624 extend along the back of each finger portion 606 of the diagnostic glove 600 and are guided through line guides 626 at the back of each joint in each finger and attached to the distal end of the finger at the anchor 628 which is located on the fingernail portion 610. The compressor/pressure transducer module 620 is affixed to the under side of the glove at the inside wrist portion 612 of the diagnostic glove 600. The fill tube 630 extends from the compressor/pressure transducer module 620 and into the compressible substance 614 to the chamber 616 within the compressible substance 614. Again, the compressible substance 614 is attached or molded into the palm portion 604 of the glove as described above and elastic members, such as the bands or webs described above, are also present (although not shown in FIG. 6). Furthermore, the displacement transducer module 618 and the compressor/pressure transducer module 620 use an output line 632 to couple to the computer interface 634. The computer interface 634 may be attached to a computer or to a controller of a hand therapy system, for example, as described below with reference to FIG. 10.

In operation, the diagnostic glove 600 is used to quantify the movement of each of the fingers, the pressure or force applied as the fingers close and squeeze the compressible substance 614, and the work done by the hand during the exercise or rehabilitation as well as the number and speed of repetitions performed. The glove is constructed similarly to the gloves described above in its basic structure. However, the diagnostic glove 600 uses a compressible substance 614 that has a chamber 616 inside which is used to for measuring the pressure within the chamber 616 resulting from the force as applied by the fingers onto the compressible substance 614 (also referred to as a squeezable substance). The chamber 616 is filled with air, a gas, a fluid or a gel through the fill tube 630 that extends from the compressor/pressure transducer module 620 into the compressible substance 614. The compressor/pressure transducer module 620 is typically controlled by a separate controller, which is part of a hand therapy system and is further described with reference to FIG. 10. Thus, when the user's hand is closed and pressure or force is applied to the compressible substance 614, a portion of the gas or fluid content within the chamber 616 is forced out through the fill tube 630 into the compressor/pressure transducer module 620. The pressure transducer portion of the compressor/transducer module 620 translates this push of gas, fluid, or gel into a signal proportional to or representing the pressure or force applied by the fingers against the compressible substance 614. This signal is output using output line 632. Valves may be used at the entry of the fill tube 630 into the chamber 616 to help establish the required pressure level within the chamber 616.

Figure 7A:
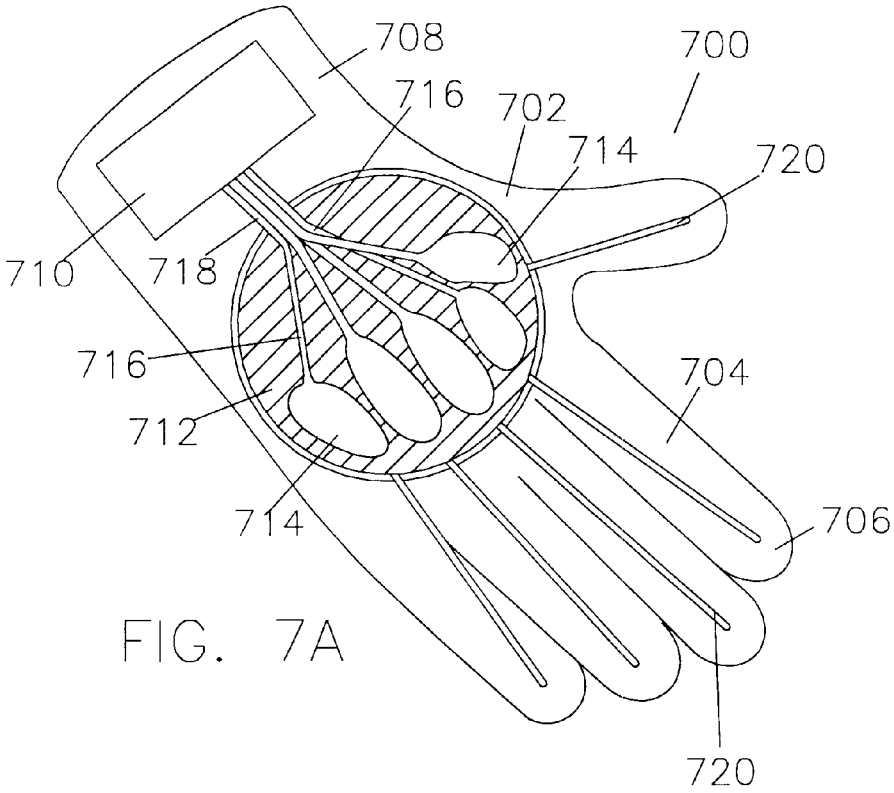
FIG. 7A is a palm view of another embodiment of the diagnostic glove of FIG. 6 is shown including multiple chambers within the compressible substance.
Figure 7B:
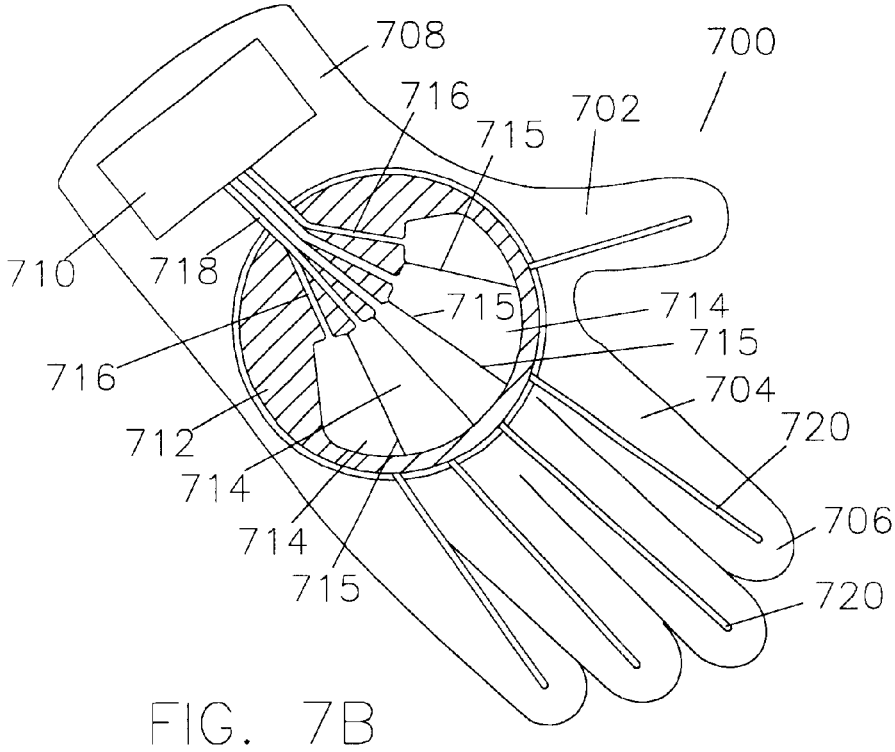
FIG. 7B is a palm view of another embodiment of the diagnostic glove of FIG. 7A wherein the multiple chambers of the compressible substance are separated by walls.
Figure 8:
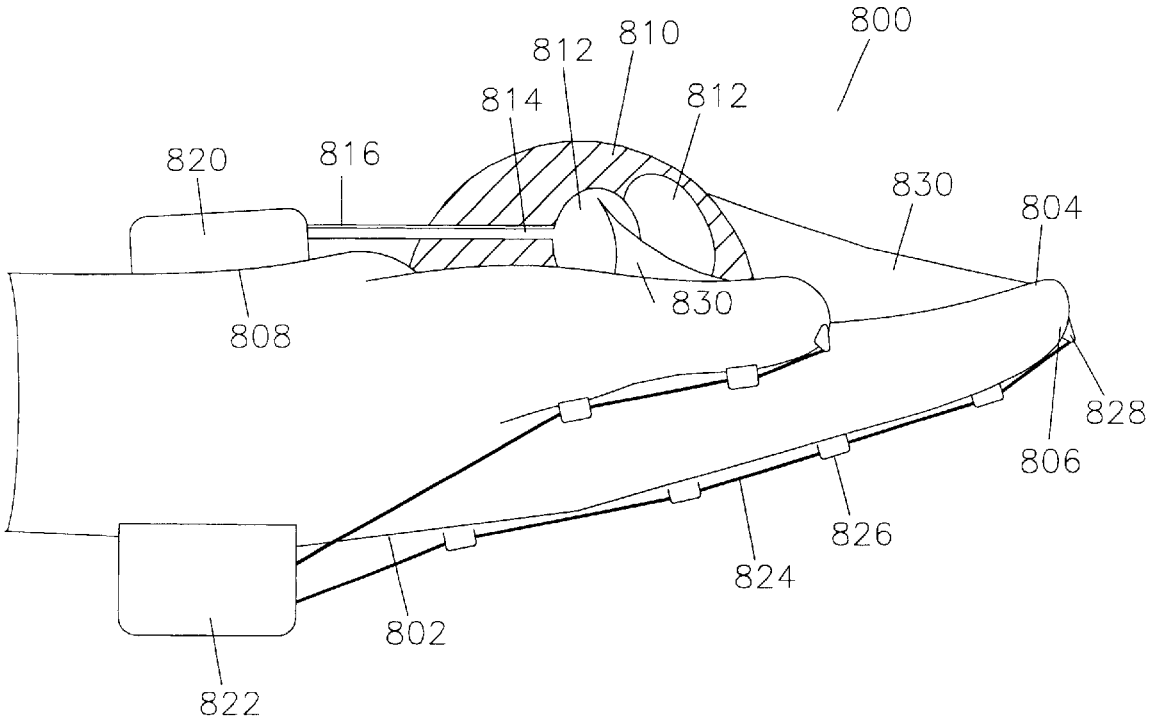
FIG. 8 is a palm-up, side view of the embodiment of the diagnostic glove of FIG. 7A and including a displacement transducer module of the embodiment of FIG. 6.

The compressible substance 614 is shown as having a single chamber, but may include separate chambers located within the compressible substance 614 such that a force or pressure estimation can be obtained for each of the individual fingers (this is illustrated in FIGS. 7A through 8). The compressible substance 614 may be constructed with materials such as rubber, PVC, silicone, neoprene, cloth, latex, or other compressible materials as known in the art. These materials may be fabricated into a chamber (or multiple chambers) by casting, molding, or die cutting and RF welding or adhesive bonding of flat sheets. Readily available processes such as those used to make inflatable life preservers, blood pressure cuffs, and intravenous tubesets would be amenable to making the compressible substance 614.

The compressor portion of the compressor/pressure transducer module 620 is a pneumatic or fluidic component, which uses a compressor or pump. This compressor is a miniature mechanical compressor, such as those commercially available from Gast located in Benton Harbor, Mich. or Medo USA of Hanover Park, Ill. or Sensidyne of Clearwater, Fla., and are used to inflate the compressible substance to a therapeutic pressure. The compressor may be a part of the compressor/pressure transducer module 620 as shown or may be a separate unit that is worn on the body of the user (e.g. on the user's belt) or placed nearby the user and attached to the compressible substance 614 via a tube. The timing and rate at which the compressor inflates or pressurizes the chamber 616 within the compressible substance 614 may be set by a separate controller (see FIG. 10). Alternatively, a squeezable ball, such as used in blood pressure cuffs, may be used to inflate the chamber, or a miniature tank of compressed gas.

Furthermore, valves may be used in addition to the compressor. For example, micro solenoid valves like those used in inkjet printers or pinch valves like those used in pneumatic systems can be used to control the air or fluid flowing in and out of the chamber 616 of the compressible substance 614. Such valves could be open or shut, or pulsed, working in concert with the compressor or pump to control the pressure in the chamber 616 (or chambers) and the rate at which they are inflated or filled. These valves are readily available, such as commercially available from Lee Company of Westbrook, Conn. or SMC, located in Indianapolis, Ind.

Figure 16:
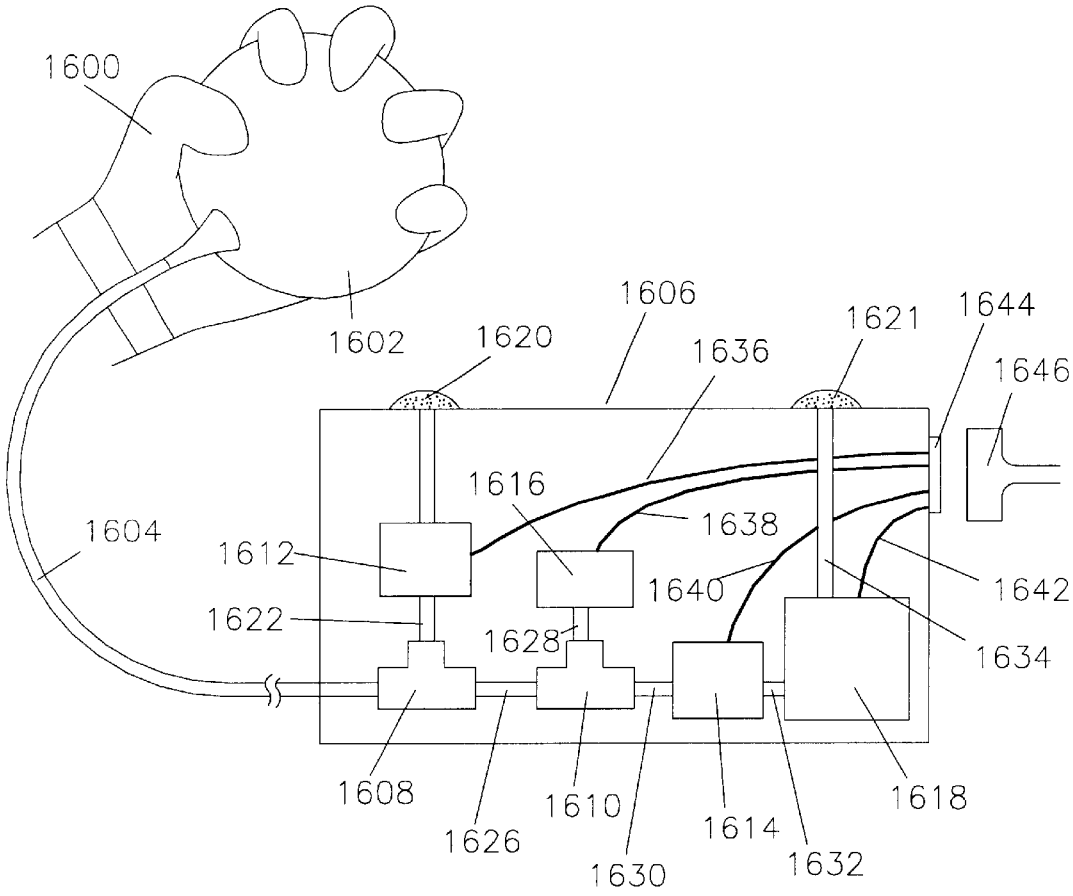
FIG. 16 is a view of one embodiment of the compressor/pressure transducer module of the diagnostic glove of FIG. 6.

The pressure transducer portion of the compressor/pressure transducer module 620 is a transducer that produces a signal; e.g. a voltage proportional to the pressure applied to its port, which is proportional to or represents the pressure or force applied by the user onto the compressible substance 614. Typically, the pressure measured at the port of the pressure transducer is directly proportional to the pressure or force applied by the fingers on the compressible substance, although different configurations and different materials may alter the proportionality. Typically, the port of the pressure transducer is positioned at the end of the fill tube 630 within the compressor/pressure transducer module 620 so that the gas or fluid that is forced from the chamber 616 of the compressible substance 614, during the action of closing the user's hand, against the port of the pressure transducer. In response to the pressure against the port of the pressure transducer, the pressure transducer outputs a signal that is proportional to or represents the pressure inside the chamber 616. Such pressure transducers are well known in the art and are commercially available from Honeywell located in Minnesota. Finally, the compressor/pressure transducer module 620 also uses output line 632 that is coupled to the computer interface 634, which in turn may be coupled to a controller of a hand therapy system (see FIG. 10). A specific example of the compressor/pressure transducer module is shown in FIG. 16 described below.

Figure 12:
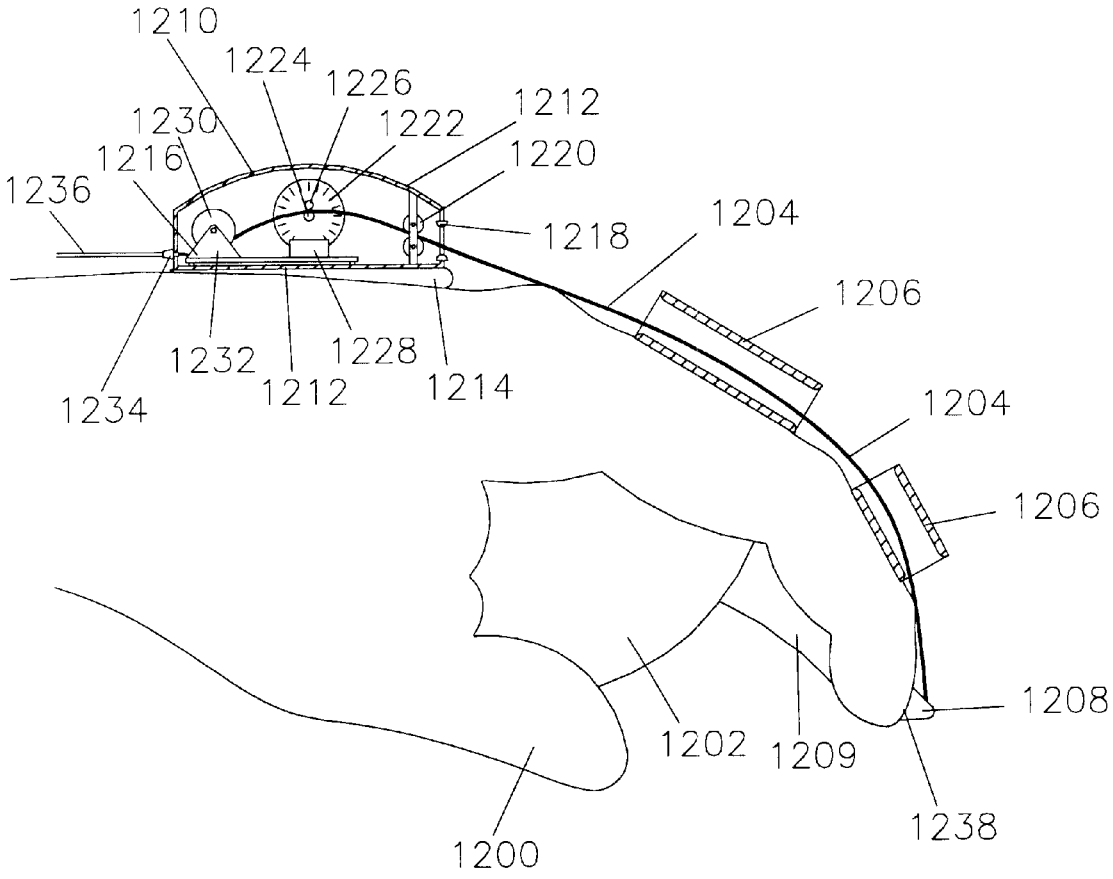
FIG. 12 is a palm-down side view of the diagnostic glove of FIG. 6 illustrating one embodiment of the displacement transducer module.

The displacement transducer module 618 is typically fixed to the back portion 602 of the diagnostic glove 600 and contains the means to measure the distance traveled by each finger as the fingers are opened and closed. One embodiment of a displacement transducer module 618 that can measure the distance traveled or the motion of the hand is a rotary encoder system, which is similar to those found in a computer mouse. Within the displacement transducer module 618, a shaft of the rotary encoder is coupled to a spool or roller carrying the line 624, which is a low stretch, monofilament or wound thread. Ideally, the spool or roller is spring loaded so that the line 624 is pulled tight from the anchor 628 to the spool of the displacement transducer module 618. The distal end of the lines 624 are attached to an anchor 628 located at the finger nail portion 610 of the finger portion 606. At each joint of the finger, the lines 624 pass through respective line guides 626. The line guides 626 are fixed at the surface of each joint of the finger and typically have a hole extending therethrough (Alternatively, the line guides 626 may have a channel formed within at the exterior surface for guiding the line 624). The line 624 feeds through the hole in the line guide 626. The lines 624 are designed to have desired stiffness so that they can be easily fed through the holes in the line guides 626. Alternatively, the lines 624 may pass through a flexible protective tubing (as shown in FIG. 12) so as to protect the lines during use.

In use, when the hand is closed, each finger flexes and the respective lines 624 are drawn from the spool causing the rotary encoder to transmit electrical pulses whose number is in proportion to the flexing and movement of each finger. The stiffness of the line 624 returning through the line guides 626, or a light-force spring return mechanism in the spool or roller would return the line 624 back onto the spool or across the roller as the finger extends (i.e. the hand is opened), providing extension and flexion displacement data. Thus, the rotary encoder can determine the magnitude of the movement, so that a complete range of movement while opening and closing the hand may be modeled. The displacement transducer module 618 will output a signal over output line 632 to the computer interface 634 that is proportional to or represents the displacement of the fingers both while closing and opening the hand. Specific embodiments of the displacement transducer module 618 are described below with reference to FIGS. 11 through 15 and line system is described also below with reference to FIGS. 9A and 9B.

Alternative types of displacement transducers include the use of strain gauge transducers that could be integrated or mechanically attached via the glove to individual joints, whole fingers, or the entire grasping surface of the hand. These strain gauge transducers also produce an electrical signal in proportion to the motion of each finger. They work on a variety principles: piezo electric, electro mechanical (like a condenser microphone), accelerometer, and variable resistance strain gauge. These transducers, and their detector circuits, are readily available in scientific materials catalogs like Cole Parmer, located in Vernon Hills, Ill. An example of such strain gauge modules is shown in U.S. Pat. No. 5,280,265 issued Jan. 18, 1994 to Kramer, et al., entitled "STRAIN SENSING GONIOMETERS, SYSTEMS AND RECOGNITION ALGORITHMS", which is incorporated herein by reference.

Other examples of displacement transducer modules are optical flex sensors for modeling hand movements used in virtual reality applications. Such optical flex sensors are shown in U.S. Pat. No. 4,414,537, issued Nov. 8, 1983 to Grimes entitled "DIGITAL DATA ENTRY GLOVE INTERFACE DEVICE" and U.S. Pat. No. 4,542,291, issued Sep. 17, 1995 to Zimmerman entitled "OPTICAL FLEX SENSOR", both of which are incorporated herein by reference.

Additionally, a thermal transducer 622 is positioned within the diagnostic glove 600, ideally at the inner surface of the palm portion 604. The thermal sensor, such as a platinum probe resistance temperature device (RTD) or iron-constantan thermocouple, measures the temperature rise of the hand during exercise. Since the glove is a thermal insulator, the temperature rise recorded by the thermal transducer (also referred to as a thermocouple) will provide a calorimetric estimate of the work being done by the hand. The output of the thermal transducer 622, which is a signal representing temperature rise of hand, is coupled from the diagnostic glove to a separate controller via the output line 632. This estimate of work is a simple and inexpensive way of measuring the progress of a patient's therapy.

Thus, advantageously, adding several features and means to the basic design of the hand rehabilitation device or hand exercise device, a diagnostic glove 600 is created which has outputs that are proportional to or represent the pressure that the fingers apply to the compressible substance 614, the temperature increase of the hand during use, and a measurement of the overall movement of the fingers when opening and closing the hand. These output signals may also be used to determine the number and speed of repetitions. The body of the diagnostic glove 600 is conventional while the diagnostic glove 600 itself is a unique combination of conventional and non-conventional components. Additionally, the diagnostic glove 600 includes an output line 632 and a computer interface 634, such that the measurements of the diagnostic glove may be input into a computer system that may be used to display and store the measurements and/or control the pressure within the chamber 616 of the compressible substance 614.

The diagnostic glove 600 has several applications. Since the diagnostic glove can output finger displacement, pressure and temperature signals, a therapist can monitor these results of a therapy session. With such monitoring, the therapist can proscribed additional therapy, e.g. proscribe more repetitions, at a higher pressure. Additionally, the diagnostic glove 600 may be used for testing purposes, in that it may be used to objectively test a user's manual dexterity for example. Thus, the diagnostic glove may objectively measure the range of a user's fingers and the pressure or force the user is able to place upon the compressible substance and additionally determine how fast a user can perform such exercise or how many repetitions a user can perform at a specified pressure level. The results could be compared to a standard performance level or a desired performance level; thus, a user's performance may be quantified and assessed by an operator.

Referring next to FIG. 7A, a palm view of another embodiment of the diagnostic glove of FIG. 6 is shown including multiple chambers within the compressible substance. Shown are the diagnostic glove 700 having a palm portion 702, wrist portion 708, finger portions 704 and fingerprint area 706, the compressor/pressure transducer module 710, the compressible substance 712 including five chambers 714 and five fill tubes 716 extending through a main fill tube 718. Also shown are the elastic members 720.

The embodiment shown in FIG. 7A is similar in operation to the embodiment shown in FIG. 6; however, the chamber within the compressible substance 712 is divided into 5 separate chambers 714. Each of the five separate chambers 714 is positioned within the compressible substance 712 such that upon the closing action of the hand, the fingers will each press against a respective one of the chambers 714. Similarly, instead of one fill tube, there is a separate fill tube 716 for each of the five chambers 714. Each fill tube 716 extends through the compressible substance 712 into the compressor/pressure transducer module 710 via a main fill tube 718. Furthermore, the compressor/pressure transducer module 710 actually contains five separate pressure transducers one for each chamber 714. Thus, advantageously, the diagnostic glove 700 can more accurately measure the pressure applied by each of the respective fingers against the compressible substance 712. This information may be used by the user or therapist to determine if the user is favoring one finger or not evenly applying pressure with all fingers. This feature represents an improvement in tailoring the specific program for user or patient rehabilitation. Thus, as is further described with reference to FIG. 10, the user or therapist may accordingly adjust the pressure within each of the respective chambers 714 in the event the user can not apply pressure at the desired level for a specific finger (i.e. specific digit).

Note that the elastic members 720 described earlier are also shown in FIG. 7A, and are molded or sewn or otherwise attached the compressible substance 712 and the finger portions 704 at the fingerprint area 706 as described above. Furthermore, in the event the elastic members 720 are webs, they may be attached or molded at their edge (not shown) along the length of the finger portions 704.

Referring next to FIG. 7B, a palm view is shown of another embodiment of the diagnostic glove of FIG. 7A wherein the multiple chambers of the compressible substance are separated by walls 715. The diagnostic glove 700 of FIG. 7B has the same components as FIG. 7A, with the addition of walls 715 that separate the chambers 714 within the compressible substance 712. As can be seen, walls 715 are molded in between the individual chambers 714 of the compressible substance 712. Such walls 715 are slightly more rigid than the remaining material of the compressible substance 712 so that pressure applied to one chamber 714 will not in effect apply pressure to an adjacent chamber. Therefore, the majority of the pressure will be channeled such that the gases (e.g. air) or fluids within the individual chambers 714 will be forced out of the chamber 714 into the fill tubes 716 and not expand sideways into adjacent chambers, potentially effecting the pressure measurements obtained in the adjacent chambers.

In order that the walls do not substantially interfere with the closing motion of the fingers as the fingers are pressed into the compressible substance 712, the walls 715 should be aligned in between the locations where the fingers or digits contact the compressible substance 712. Furthermore, the walls 715 should not be so rigid that they do not allow the compressible substance to adequately be compressed or squeezed. These walls 715 may be molded as described above while the compressible substance 712 is being formed. Alternatively, the walls 715 could be made to be rigid; thus, the fingers must be depressed in between the walls 715. These rigid walls would almost completely eliminate pressure from an adjacent chamber from having an effect on a given chamber's pressure reading. As another alternative, the walls themselves may be the elastic members 720 (as webs) that extend through slits in the compressible substance 712. These slits and elastic members are described with reference to FIG. 1. Thus, the elastic members 720 would extend through the compressible substance 712 and attach to the palm portion of the diagnostic glove, while at the same time forming walls between chambers 714 of the compressible substance 712.

Referring next to FIG. 8, a palm-up side view is shown of the embodiment of the diagnostic glove of FIG. 7A and including the displacement transducer module in the embodiment of FIG. 6. Shown is the diagnostic glove 800 having the back portion 802, the palm portion, fingerprint area 804, fingernail area 806, and wrist area 808. Also shown are the compressible substance 810 including chambers 812 for each respective finger or digit, and fill tubes 814 within a main fill tube 816, the compressor/pressure transducer module 820, displacement transducer module 822, lines 824, line guides 826, anchor 828, and the elastic members 830 (shown as elastic webs, but could also be elastic bands).

The individual chambers 812 within the compressible substance are better illustrated including their positioning within the compressible substance in FIG. 8. The chambers 812 are positioned such that when the fingers are closed, the fingers press against the respective chamber 812 that is aligned with the respective finger, and not the chamber associated with adjacent fingers. Thus, the gas or fluid within each chamber 812 is forced through a respective fill tube 814 to a respective pressure transducer within the compressor/pressure transducer module 820 via the main fill tube 816. It is also noted that the compressor may not be within the compressor/pressure transducer module 820, but may be located elsewhere on the body of the user or located proximate to the user. Also, the entire compressor pressure transducer module 820 could be located separate from the glove and attached by the fill tube 816. Thus, the compressor is coupled to the fill tubes 814 through the pressure transducer. For example, the compressor and the pressure transducer are both coupled to the fill tubes, but a valve or similar functioning device cuts off the compressor from the fill tube when the user is using the diagnostic glove. Furthermore, there are actually five pressure transducers as a part of the compressor/pressure transducer module 820, one for each digit or finger. Additionally, the displacement transducer module 822 functions as described above.

Figure 9A:
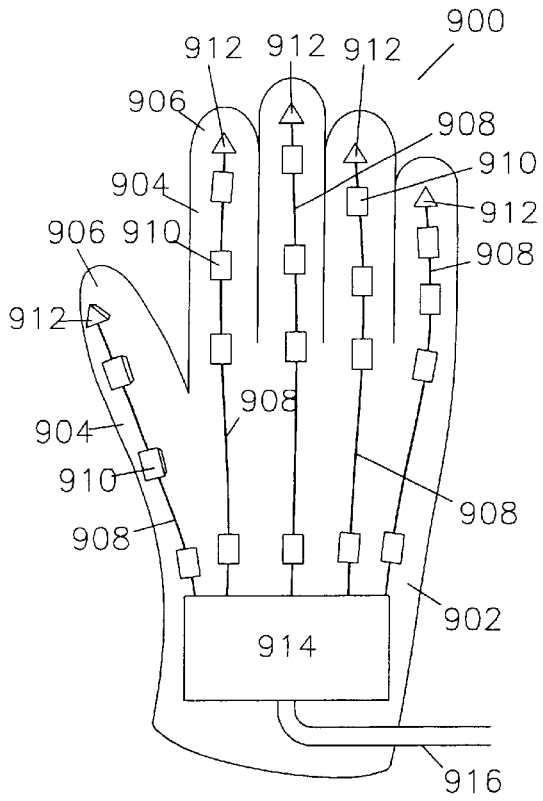
FIGS. 9A and 9B are views of the back of the diagnostic glove of FIG. 6 illustrating the displacement transducer module and line configurations.
Figure 9B:
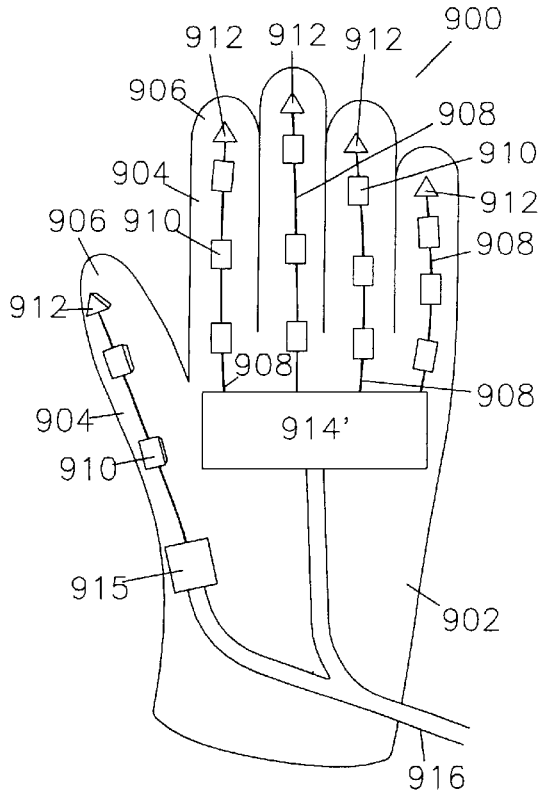

Referring next to FIGS. 9A and 9B, two different embodiments are shown for the displacement transducer module and the structure used to measure the displacement of the each finger during the opening and closing of the hand. Shown are the diagnostic glove 900 including the back portion 902, finger portion 904, fingernail portion 906, lines 908, line guides 910, anchors 912, and displacement transducer modules 914, 914' and 915 are output lines 916.

As shown and also as described above, the lines 908 are a low stretch, monofilament or wound thread that extends from the displacement transducer module 914 to the anchor 912 at the fingernail portion 906 of the glove. The lines 908 are threaded or fed through line guides 910 that have holes therein or a channel formed at the exterior surface (alternatively, the line guides 910 may be flexible hollow tubes). The line guides 910 are fixed at the joints of each finger and thumb (i.e. the five digits) and are made of plastic or other polymers or alternatively could be made of cloth or other suitable materials. The lines 908 are wound onto a spring loaded spool or a spring tensioned roller such that the lines 908 are held relatively tightly from the anchor 912 at the distal end of the displacement measuring system and the displacement transducer. Note that the lines 908 are held tightly enough to resist the closing motion of the hand or assist in the opening motion of the hand, but just tight enough to keep the lines 908 taut. The displacement transducer module 914 may be configured as described above with reference to FIG. 6 and below with reference to FIGS. 11 through 15.

As shown in FIG. 9A, a single displacement transducer module 914 is located on the back portion 902 of the diagnostic glove 900. The displacement transducer module 914 contains five separate displacement transducers, one for each line 908 extending to the tip of each finger. The displacement transducer module 914 has single output 916 which includes a computer interface (not shown). The computer interface may be coupled to a hand therapy system described below.

As shown in FIG. 9B, the displacement transducer module is broken into two separate modules, first displacement transducer module 914' and second displacement transducer module 915. The first displacement transducer module 914' contains the displacement transducers, i.e. rotary encoders with the spools or rollers, for the four fingers and the second displacement transducer module 915 contains the displacement transducers for the thumb. Again, output line 916 is shown, which is attached to a computer interface.

Figure 10:
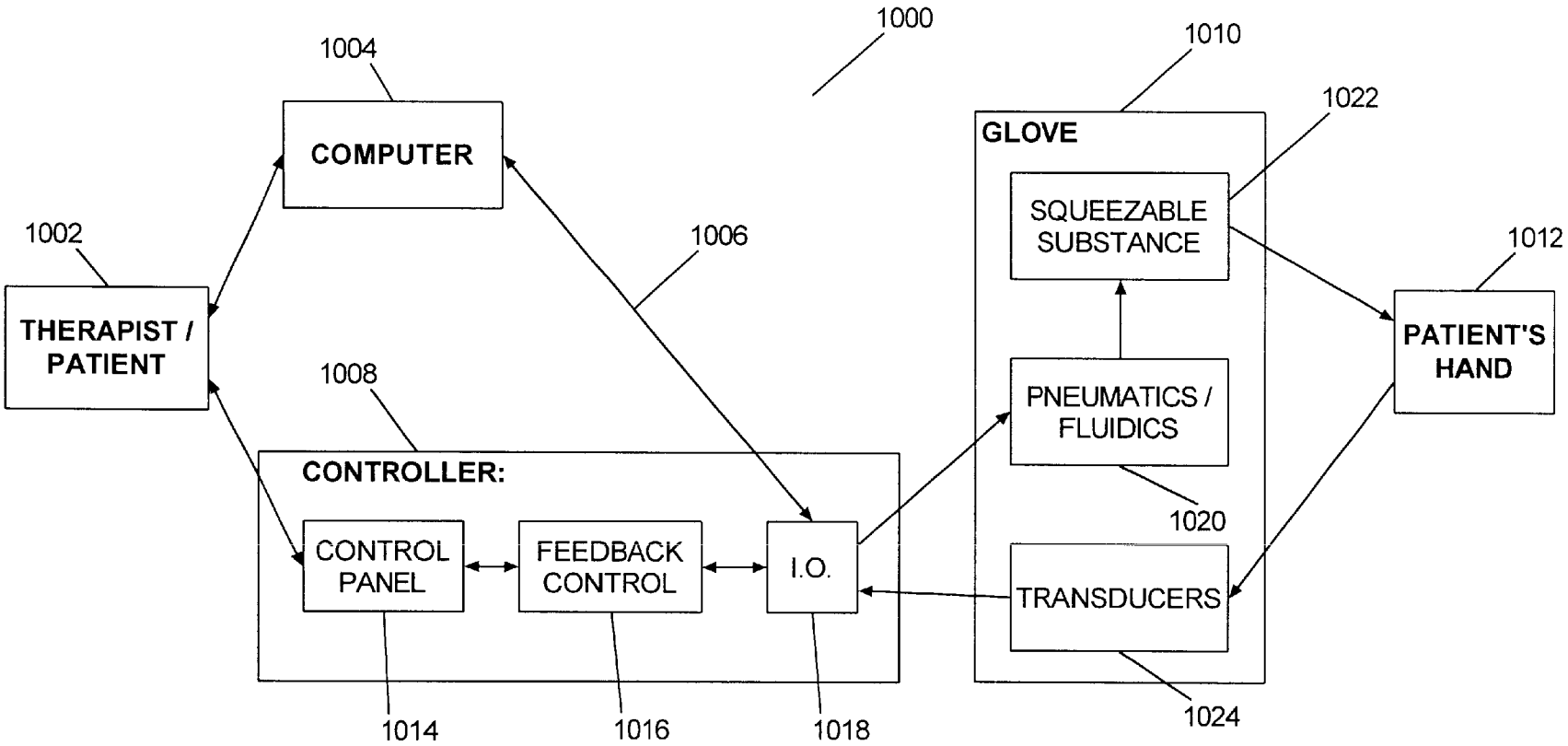
FIG. 10 is a functional block diagram of a hand therapy system incorporating the diagnostic glove as shown in FIGS. 6 through 9B.

Referring next to FIG. 10, a functional block diagram is shown of hand therapy system 1000 that uses a diagnostic glove as described above with reference to FIGS. 6 through 9B. The hand therapy system 1000 includes the therapist/patient 1002, computer 1004, computer link 1006, controller 1008, diagnostic glove 1010, and the hand 1012. The controller 1008 includes a control panel 1014, feedback controller 1016, and input/output 1018 (also referred to as IO 1018). The diagnostic glove 1010 includes a pneumatics/fluidics module 1020, the compressible substance 1022, and transducers 1024.

The therapist/patient block 1002 is coupled to the computer 1004 and control panel 1014 of the controller 1008.

The control panel 1008 is coupled to the feedback controller 1016 of the controller 1008 which is coupled to the input/output 1018 (IO) of the controller 1008. The computer 1004 is coupled to the IO 1018 of the controller 1008 via the computer link 1006. Furthermore, the IO 1018 of the controller 1008 is coupled to the pneumatics/fluidics module 1020 of the diagnostic glove 1010, which is coupled to the compressible substance 1022 of the glove. The transducers 1024 are coupled back to the IO 1018 of the controller 1008. The hand 1012 of the user interacts with compressible substance 1022 and the transducers 1024 of the diagnostic glove 1010.

In operation, the hand therapy system works 1000 with the diagnostic glove 1010 to provide a means for measuring the motion, force and work done by the user of the diagnostic glove 1010. Furthermore, it provides a means for controlling the pressure resistance of the compressible substance 1022 of the diagnostic glove 1010 automatically, so that therapy parameters can be set and maintained automatically by the patient's or therapist's interaction with the controller 1008.

The therapist/ patient block 1002 represents both the user or patient and the therapist. As shown in this embodiment, both the user and the therapist have access to the measurements obtained using the diagnostic glove 1010 in addition to being the operators of the hand therapy system 1000. Both the user and the therapist can set the therapy parameters such as resistance pressure (of the compressible substance 1022), and will review the therapy outcomes such as joint movement, pressure or force applied, and work done. Over time, the therapist will adjust the therapy parameters to reflect the best plan of treatment. The therapist may interact with the hand therapy system 1000 directly through the computer 1004 or remotely over a computer network via the computer link 1006, such as the Internet link, as described below.

The computer 1004 is either physically integrated with the controller 1008 in a monolithic enclosure, located in the vicinity of the controller 1008, or connected to the controller 1008 via a computer network (e.g. the internet) through the computer link 1006 (e.g. an internet link). It provides a readily accessible way for the therapist to adjust parameters and review treatment, locally and remotely. The computer 1004 stores and organizes therapy parameters and outcomes in a database for archival and ready access. It also converts outcomes data into a graphical charts displayable on a computer terminal and printable on paper that ease the interpretation of the outcomes data and help the therapist make better decisions.

The controller 1008 is the electronic brain of the hand therapy system 1000. It might be a standalone unit, located near the patient, or it might be a miniature battery operated controller that is integrated onto the glove (e.g. as an attachment to the compressor/pressure transducer module or the displacement transducer module). The controller 1008 receives signals from the transducers 1024 of the diagnostic glove representing finger displacement (from the displacement transducers), force applied (from the pressure transducers) and work (measured as a calorimetric estimate from the thermal transducer) and contains the algorithms necessary to translate the signals from the various transducers into the respective estimations of the finger displacement, temperature and force or pressure applied. Such algorithms for translating these conventional signals supplied by conventional transducers are well known in the art; thus, no further explanation is required. The controller 1008 is also able to determine the number of repetitions and speed of repetitions, for example, by comparing the direction of the displacement signals received and when the signals "change direction" (indicating a change from opening to closing of the hand, for example) to a timer or clock. The controller also sends control signals to the compressor (within the pneumatic/fluidics module 1020) of the diagnostic glove to set the glove's resistance (e.g. the compressor and valve settings). The controller 1008 contains an embedded computer that manages the activities of the controller, translates the signals from the transducers, and maintains communications between the controller 1008, the diagnostic glove 1010, and its users. It could be a custom computer, or be a common personal computer running commercially available software, such as National Instruments' Labview.

The controller 1008 is comprised of the subsystems of the feedback controller 1016, control panel 1014 and the IO 1018. The control panel 1014 consists of knobs, buttons and displays that allow the user to set therapy parameters and review therapy outcomes. Theses knobs, buttons and displays are electronically connected to the controller's 1008 embedded computer. The control panel 1014 may be configured so that the user/therapist can: set the initial and final pressure resistance level of the compressible substance 1022 within the diagnostic glove; set a repetitions counter or therapy timer; set limits and alarms for excess pressure or other abnormal conditions; set control parameters for the feedback controller 1016, such as PID (proportional, integral, derivative) constants; store parameters for future use; and control the power to the controller 1008.

Additionally, the control panel 1014 may provide a display indicating real time indications of pressure, displacement, and work in aggregate or on a finger by finger basis, as well as graphical displays of such measurements. Additionally, the diagnostic glove settings may be shown. Such displays may be displayed on a corresponding computer or on a screen or display of the controller itself depending on the embodiment.

The knobs, buttons and displays comprising the control panel 1014 are commercially available from many sources as discrete components or integrated into control panel assemblies. Displays are widely available in the following forms: LED alphanumeric displays, LCD alphanumeric and graphic displays, electro luminescent and plasma displays, and cathode ray tubes.

The feedback controller 1016 allows the pressure resistance of the compressible substance 1022 to be adjusted automatically in dynamic response to predetermined pressure profiles and sequences, existing pressure in the chamber/s of the compressible substance 1022, finger motion, and the work being done. The feedback controller 1016 is a function performed by the controller's embedded computer. It receives the real-time pressure, displacement, and work measurements, then uses readily available algorithms, such as PID (proportional, integral, derivative) control to send the proper signals to adjust the valve settings and the compressor (within the pneumatics/fluidics module 1020), to maintain the pressure resistance within the chamber/s of the diagnostic glove 1010 according on the therapist's or user's settings. The feedback controller 1016 contains therapy data storage circuits, parameter storage circuits, and a real time clock that permit it to operate autonomously.

The IO 1018 allows the controller 1008 to communicate with the diagnostic glove 1000 and the computer 1004. The IO 1018 outputs signals to the pneumatic/fluidic module 1020, which contains the compressor and the valves, to control the amount of pressure that the chambers are inflated or filled up to in order to provide the appropriate resistance when the user squeezes the compressible substance 1022. These output signals might be pulsed waveforms intended to switch the compressor and valves on and off, or they may be analog voltage signals intended to set the compressor speed. The IO 1018 also receives signals from the transducers 1024, e.g. pressure transducer, displacement transducers and thermal transducer. These received signals might be pulsed waveforms, or analog voltage levels as output from the respective types of transducers 1024.

Additionally, the IO 1018 may perform data communications with the computer 1004 via the computer link 1006. The computer 1004 is typically the therapists computer, which may be physically attached to the controller 1008 through serial interfaces or may be linked via a computer link 1006 to the controller. The computer 1004 may be part of a local area network or wide area network or other computer network. Thus, the therapist may be located at another location than the user. Advantageously, the user may operate the hand therapy system 1000 at home and be simultaneously monitored by the therapist online with the controller 1008. Thus, the therapist can send signals from the therapists computer 1004 to the controller 1008 via the computer link 1006 (such as an internet link) to control or set the parameters of the patient's session in response to the measurements of the diagnostic glove 1000. Advantageously, the therapist can see the results of the session (i.e. the estimations of finger displacement, work, force or pressure, and the number and speed of repetitions) and make desired changes to further facilitate improve in a patient's condition without having to be physically present at the session. Furthermore, the computer 1004 (in addition to or instead of the controller 1008) may also be capable of translating the signals output from the transducers into the appropriate measurements of displacement, work, pressure or force, and the number and speed of repetitions.

The IO 1018 will comprise many different circuits including: pulse width modulation circuits that will generate a pulsatile waveform to control the compressor and valves of the pneumatics/fluidics module 1020; digital to analog circuits to create a variable voltage level to adjust the compressor speed; driver circuits to convert the outputs from the pulse width modulator and the digital to analog circuit into the proper voltage and current to supply the valves and the compressor; transceiver circuits to convert the pulsed waveform from the displacement transducers into a computer readable form; analog to digital circuits to convert the signals from the displacement transducers, temperature sensors, and pressure transducers into computer readable form; and also data communication circuits such as a modem, Ethernet transceiver, USB transceiver, infrared or RF transceivers, or a simple serial interface to allow connection to the computer (e.g. the therapist's computer if it is located near the IO 1018).

These circuits are commercially available as add-on-boards for personal computers through companies like National Instruments located in Austin, Tex. They are also readily constructed from available components from electronics components made by manufacturers like Texas Instruments (located in Dallas, Tex.) and National Semiconductor (located in Santa Clara, Calif.), available through distributors and catalog sources like DigiKey and Newark Electronics. The circuits themselves are well-understood and are described in readily available reference books.

The diagnostic glove 1000 operates as described above with reference to FIGS. 6 through 9B and FIGS. 11 through 15. In FIG. 10, the diagnostic glove 1000 comprises the pneumatics/fluidics module 1020, the compressible substance 1022, and the transducers 1024. The pneumatics/fluidics module 1020 contains the compressor and appropriate valves of the compressor/pressure transducer module described earlier. The pneumatics/fluidics module 1020 receives signals from the controller 1008, either generated by the therapist or the user, to regulate the air or fluids going into and out of the compressible substance 1022. Thus, the controller 1008 sends the appropriate signals to make sure the pressure within the compressible substance is as desired. Again, as described above, the pneumatics/fluidics module may comprise an electronically controlled compressor (or pump) and/or valves.

The compressible substance 1022 is also as described above and includes a flexible enclosure containing one or more chambers within the compressible substance 1022. The multi-chamber compressible substance as shown in FIGS. 7A through 8 would permit resistance pressure regulation on a finger-by-finger basis, whereas a single chamber, such as shown in FIG. 6, would be a simpler way to regulate the pressure resistance of all the fingers together. The compressor and/or valves (of the pneumatics/fluidics module 1020) would be connected to the fill tubes leading to each chamber, to establish air or fluid pressure in each chamber and to regulate the flow in and out of each chamber.

The transducers 1024, as described above as the pressure transducer, the displacement transducer, and the thermal transducer, provide the measurements in the form of signals back to the controller 1008 so that determinations of finger motion, force exerted by each finger or the hand total while squeezing the compressible substance, a calorimetric estimate of the work done can be obtained by the controller 1008, and the number and speed of repetitions.

The user's or patient's hand 1012 fits within the diagnostic glove 1000 and interacts with the compressible substance 1022. The diagnostic glove 1000 is designed to snugly fit the user's hand 1012 and contains the transducers 1024 required to obtain the measurements. Additionally, the glove may be embodied as described above, including the addition of medication on the interior surface of the diagnostic glove 1000. The diagnostic glove 1000 will fit properly to the patient's hand 1012 and will provide resistance to motion that is therapeutically appropriate. Furthermore, the diagnostic glove 1000 will position and anchor the transducers 1024 and compressible substance 1022 so that the measurements are sufficiently accurate and precise.

In addition to functioning as a therapy device, the diagnostic glove may function as an objective testing and evaluating device, such that the capabilities of the user's hands can be quantified and compared to a specified performance level.

Figure 11:
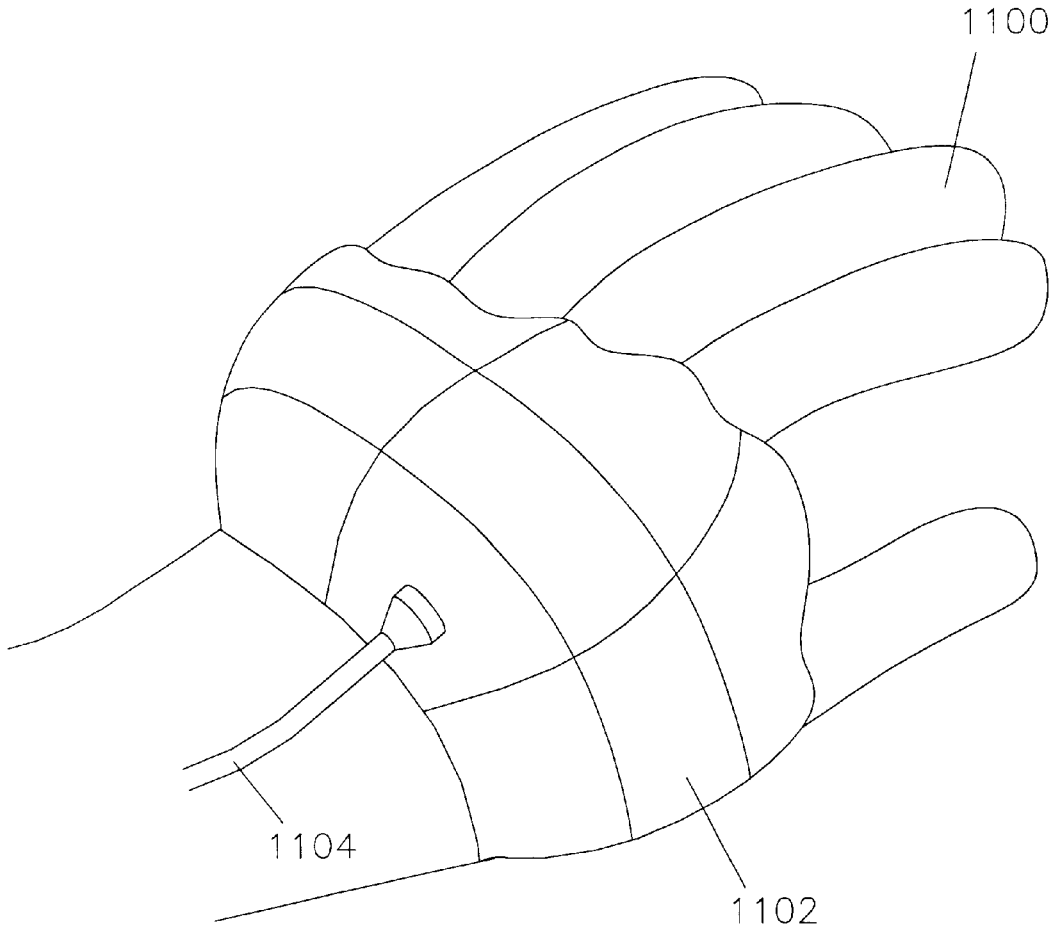
FIG. 11 is a exterior view of the displacement transducer module in one embodiment of the diagnostic glove of FIG. 6.

Referring next to FIG. 11, a view is shown of the displacement transducer module in one embodiment of the diagnostic glove of FIG. 6. Shown are the diagnostic glove 1100, the casing 1102 of the displacement transducer module, and output line 1104. As shown, the casing 1104 fits over the back of the diagnostic glove 1102 and contains the displacement transducer module. In the embodiment shown, the casing 1102 is large enough to cover and protect the displacement transducer module for all the digits of the hand. Output line 1104 is coupled to the computer interface (not shown) which couples to the controller of FIG. 10, for example. Also note that the lines and the line guides are not illustrated in FIG. 11.

Referring next to FIG. 12, a palm-down side view is shown of the diagnostic glove of FIG. 6 illustrating one embodiment of the displacement transducer module. Shown is the diagnostic glove 1200 including the compressible substance 1202, line 1204, line guides 1206 (illustrated as flexible tubes), anchor 1208, elastic member 1209 and displacement transducer module 1210. The displacement transducer module 1210 includes a casing 1212, pad 1214, circuit board 1216, eyelet 1218, first pinch roller 1220, encoder wheel 1222, encoder shaft 1224, second pinch roller 1226, encoder detector 1228, spool 1230, spool support 1232, grommet 1234 and output line 1236.

The diagnostic glove may be configured according to the embodiments described above such that the compressible substance 1202 includes one or more chambers (not shown), compressor/pressure transducer modules (not shown), and thermal transducers (not shown). These features are not shown so that the displacement transducer module 1210 can be illustrated.

The displacement transducer module 1210 is typically fixed to the back portion of the diagnostic glove 1200 and contains the means to measure the distance traveled by each digit (i.e. fingers and thumb) as the digits are opened and closed. This embodiment of a displacement transducer module 1210 is a rotary encoder system, which is similar to those found in a computer mouse. The displacement transducer module 1210 is housed within a casing 1212, as illustrated in FIG. 11. The casing 1212 includes eyelets 1218 for receiving the lines 1204. Again, the lines 1204 are attached at the anchor 1208 located at the fingernail portion 1238 of each digit. In this embodiment, the line guides 1206 are shown as flexible tubes but could also be rigid plastic guides having holes or channels formed therein as described above. Note that the line guides are positioned in between the joints of the digits, but could alternatively be placed at each joint. For example, instead oftwo line guides 1206 as shown for each digit positioned between the joints, there could be three line guides 1206 for each digit positioned at each joint.

The lines 1204 enter the displacement transducer module 1210 through the eyelets 1218 and a first pinch roller 1220. Each line 1204 then passes between the encoder shaft 1224 and the second pinch roller 1226 and then coils around the spool 1230 which is held in place with the spool support 1232. As described above with reference to FIG. 6, the spool 1230 is spring loaded so that the line 1204 is pulled tight from the anchor 1208 to the spool 1230, but not so tightly that the finger is inhibited from closing.

In operation, during the closing motion of the hand, each finger flexes and the respective lines 1204 are drawn from the spool 1230 across the encoder shaft 1224 and the second pinch roller 1226 causing the encoder wheel 1222 to transmit electrical pulses whose number is in proportion to the flexing and movement of each finger. As the digits reopen, the light-force spring return mechanism in the spool 1230 returns the line 1204 back onto the spool 1230 and across the encoder shaft 1224 of the encoder wheel 1222, providing extension and flexion displacement data. When the line 1204 is drawn across the encoder shaft 1224, the encoder wheel 1222 is caused to rotate. The encoder wheel 1222 includes encoder bars 1238 which are sensed by the encoder detector 1228. The encoder detector may be a set of contact points or an optical sensing device, such as an IR source detector, both of which are found in common mouse technologies. The encoder detector 1228 is coupled to the circuit board 1216, which has output line 1236. The output line 1236 is coupled to the displacement transducer module 1210 through a grommet 1234. Alternatively, the encoder detector 1228 may be coupled directly to the output line 1236. The output line 1236 is then coupled to a computer interface (not shown). Thus, using common rotary encoder technologies, the displacement transducer module can output signals that can be used to model the movement of each digit during the opening and closing of the hand. Note that a separate displacement transducer module is not shown for the thumb, but is also included within the casing 1212.

Additionally, based upon the direction changes of the encoder wheel 1222 reflected in the signals output from the displacement transducer module 1210, the number of repetitions as well as the speed of the repetitions may be determined. For example, noting the direction changes of the encoder wheel 1222 and comparing the frequency of such changes to a timer or clock, the number and speed of repetitions can be determined.

Figure 13:
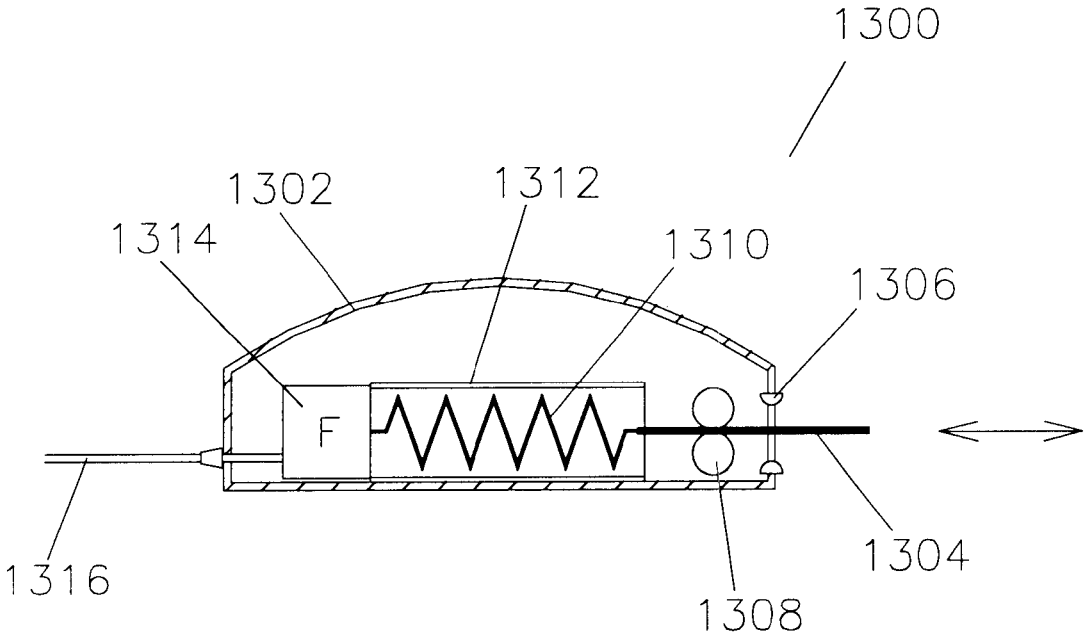
FIG. 13 is a side view of another embodiment of the displacement transducer module of the diagnostic glove of FIG. 6.

Referring next to FIG. 13, a side view of another embodiment is shown for the displacement transducer module of the diagnostic glove of FIG. 6. Shown is the displacement transducer module 1300 including a casing 1302, line 1304, eyelet 1306, pinch roller 1308, spring 1310, spring tube 1312, force transducer 1314, and output line 1316.

In this embodiment, the displacement transducer module 1300 outputs a signal that is proportional to the force created when the line 1304 is pulled out of the displacement transducer module 1300. The line 1304 enters through the eyelet 1306 and is thread through a pinch roller 1308. The line 1304 then is attached to a spring 1310, which is a low tension spring. The spring 1310 is coupled to a force transducer 1314. When the user closes his or her hand, the line 1304 is pulled from the displacement transducer module 1300. The spring 1310 is stretched which applies a force to the force transducer 1314, which outputs a signal proportional to the force applied by the spring 1310. This signal is sent to the computer interface via the output line 1316. An appropriate algorithm may be used to then model the motion of the digits of the hand based upon the force exerted by the lines 1304 on the force transducer 1314. The components of this embodiment are well known in the art; and thus, no further explanation is required.

Figure 14A:
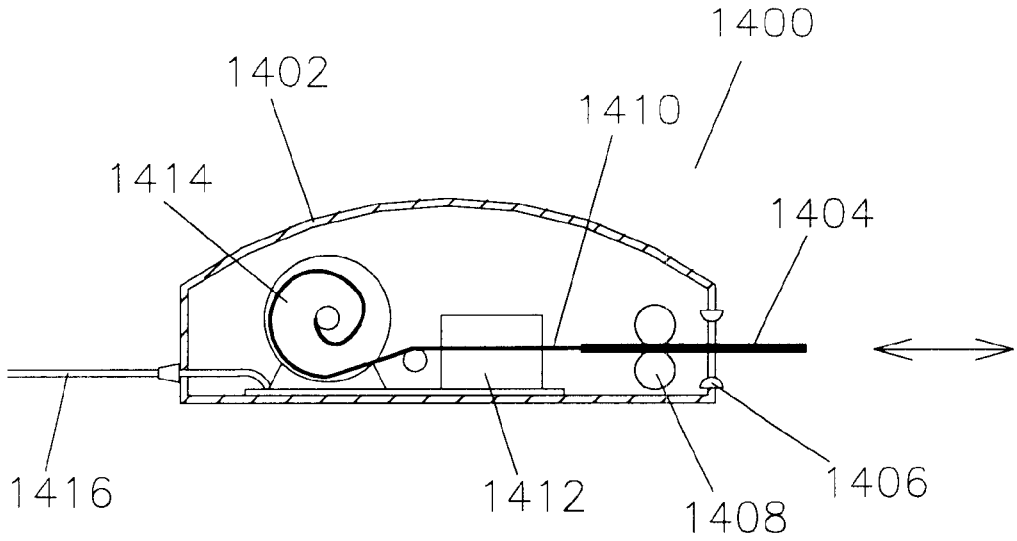
FIG. 14A is a side view of yet another embodiment of the displacement transducer module of the diagnostic glove of FIG. 6.
Figure 14B:
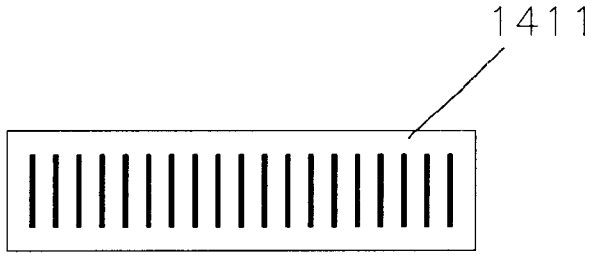
FIGS. 14B and 14C are alternative embodiments of an encoded strip of FIG. 14A.
Figure 14C:
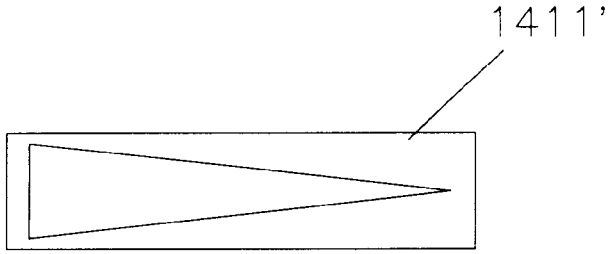

Referring next to FIG. 14A, a side view of yet another embodiment is shown for the displacement transducer module of the diagnostic glove of FIG. 6. Shown is the displacement transducer module 1400 including a casing 1402, line 1404, eyelet 1406, pinch roller 1408, encoded strip 1410, detector 1412, spool 1414, and output line 1416. FIGS. 14B and 14C illustrate a digital encoded strip 1411 and an analog encoded strip 1411', respectively, for use in the embodiment of FIG. 14A.

In this embodiment, the displacement transducer module 1400 outputs a signal that is proportional to the distance the line 1404 travels when it is pulled out of and recoils back into the displacement transducer module 1400 during the closing and opening of the hand. The line 1404 enters through the eyelet 1406 and is threaded through a pinch roller 1408. The line 1404 then is attached to the encoded strip 1410, which is a strip of material having a surface pattern printed thereon. The surface pattern is detectable using the detector 1412. Shown in FIGS. 14B and 14C, respectively, are two examples of the encoded strip 1410, a digital encoded strip 1411 including bars printed on the surface of the strip (FIG. 14B), and an analog encoded strip 1411' including a pattern having a varying thickness across the length of the encoded strip 1411' (FIG. 14C). As the encoded strip 1410 is moved across the detector 1412, the detector optically senses the patterns on the encoded strip in order to output a signal proportional to the movement of the digits of the hand. The detector may be an IR optical detector or even a pair of contacts that contact bars on the encoded strip 1410. The detector 1412 is well known in the art and is used in common mouse technologies; thus no further explanation is necessary. Again the output signal is sent to the computer interface via the output line 1416, to the controller of FIG. 10, for example. Furthermore, the software and algorithms for translating these signal into the estimations is readily available and is known in the art.

Figure 15:
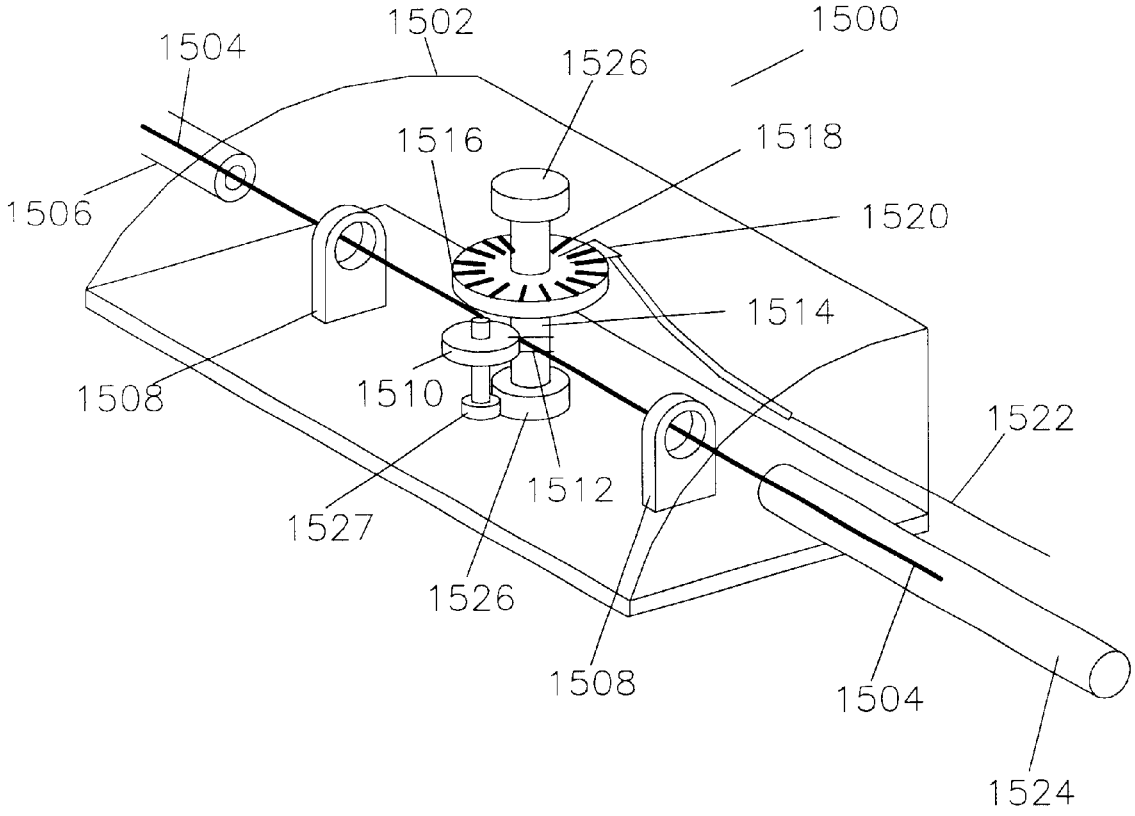
FIG. 15 is a side view shown for a further embodiment of the displacement transducer module of the diagnostic glove of FIG. 6.

Referring next to FIG. 15, a side view is shown for a further embodiment of the displacement transducer module of the diagnostic glove of FIG. 6. Shown is the displacement transducer module 1500 including a casing 1502, line 1504, first tubing 1506, guides 1508, roller 1510, retaining washer 1512, encoder shaft 1514, encoder wheel 1516, encoder bars 1518, contacts 1520, output line 1522, second tubing 1524, and supports 1526 and 1527.

In this embodiment of the displacement transducer, the line 1504, which is high tensile monofilament line, is pulled out of and pushed back into the displacement transducer module 1500 as the hand closes and opens, respectively. As the hand closes, the line is pulled through the first tubing and guides. As the line 1504 is pulled, the line 1504, which is threaded between the roller 1510 and the encoder shaft 1514 causes the encoder shaft 1514 to rotate, which causes the encoder wheel 1516 to rotate. The encoder wheel 1514 includes encoder bars 1518 and stationary contacts 1520, which sense the encoder bars as they pass under the contacts 1520. The contacts output an electrical signal that is proportional to the displacement of the fingers through output line 1522 to the computer interface (not shown). Again, this involves conventional mouse-type technologies; thus, no further explanation is required. The encoder shaft 1514 and the encoder wheel 1516 are held within the casing 1502 with supports 1526, which allow the encoder shaft 1514 to rotate therein. The roller 1510 is also held is place with support 1527 and the retaining washer 1512, which is fixed about the encoder shaft 1514.

Note that is this embodiment, there is no spring loaded spool or similar feature to recoil the line 1504. In this embodiment, the line 1504 simply terminates in a second tubing 1524 (which may be open or closed at its end) that extends from the back end of the displacement transducer module 1500, i.e. the end away from the fingers. The line 1504 is made long enough such that the line 1504 will not be pulled out of the displacement transducer module 1500. The line 1504 must be rigid enough such that the line will run across the encoder shaft 1514 and into the second tubing 1524 without bending enough to cause it to bundle up at the entrance of the second tubing.

Furthermore, in this embodiment and the other embodiments of the displacement transducer modules, the line 1504 could include a coating that would enhance the rotation of the encoder shaft 1514 during the movement of the line 1504 about the encoder shaft 1514. Such a coating would create a slight friction between the line 1504 and the encoder shaft 1514 and would ease the rotation of the encoder shaft 1514.

And finally, referring next to FIG. 16, a view is shown of an embodiment of the compressor/pressure transducer module of the diagnostic glove of FIG. 6. Shown are the diagnostic glove 1600, compressible substance 1602, first tube 1604, and the compressor/pressure transducer module 1606. The compressor/pressure transducer module 1606 includes a first tee 1608, second tee 1610, vent solenoid 1612 (also referred to as the vent valve), pump solenoid 1614 (also referred to as the pump or compressor valve), pressure transducer 1616, compressor 1618, filters 1620 and 1621, tubes 1622, 1624, 1626, 1628, 1630, 1632, and 1634, wires 1636, 1638, 1640 and 1642, the interface port 1644, and the computer interface cable 1646.

The diagnostic glove may be configured as described above, and in this embodiment, includes the compressor/pressure transducer module. The first tube 1604 enters the compressor/transducer module 1606 and is coupled to the first tee 1608. The vent solenoid 1612 is coupled to the first tee 1608 via tube 1622 and is also coupled to filter 1620 via tube 1624. Tube 1626 couples the first tee 1608 to the second tee 1610. The second tee is coupled to the pressure transducer 1616 via tube 1628 and the pump solenoid 1614 via tube 1630. The pump solenoid 1614 is coupled to the compressor 1618 via tube 1632. The compressor 1618 is coupled to the filter 1621 via tube 1634. Wire 1636 is coupled from the vent solenoid 1612 to the interface port 1644, wire 1638 is coupled from the pressure transducer 1616 to the interface port 1644, wire 1640 is coupled from the pump solenoid to the interface port 1644, and wire 1642 is coupled from the compressor 1618 to the interface port 1644. The computer interface cable 1646 couples to the interface port 1644 and is the input to a computer system, e.g. the controller of FIG. 10.

In practice, the compressor/transducer module 1606 pumps materials, such as gas., air, fluids, or gels into the chamber or chambers (not shown) of the compressible substance 1602 and provides the means for measuring the force exerted by the fingers (i.e. fingers and thumb) of the user's hand upon squeezing the compressible substance 1602. The embodiment shown in FIG. 16 inflates the chamber/s of the compressible substance 1602 with air or another similar gas.

In order to inflate the chamber/s within the compressible substance 1602, the compressor 1618 pulls air through the filter 1621 via tube 1634 and forces the air out through tube 1632. The compressor, which is a miniature mechanical compressor as described above with reference to FIG. 6, e.g. rotary vane pump, is controlled or activated by control signals sent through wire 1642. Furthermore, the compressor 1618 may be reversible, such that it may assist in the deflation of the compressible substance 1602. The pump solenoid 1614 acts as a valve and controls the flow of air into the rest of the system. Typically, the pump solenoid 1614 (controlled by signal sent via wire 1640) works in concert with the compressor 1618, such that when the compressor is "pumping" to inflate the chambers within the compressible substance 1602, the pump solenoid 1614 is open to allow the compressor 1618 to force the air therethrough. Alternatively, pinch valves may be used instead of the solenoids as described above with reference to FIG. 6. The air is pumped through tube 1630 and through the second tee 1610 into tube 1626 and the first tee 1608. The air continues through the first tee 1608 and into the first tube 1604 which is fed into the chambers of the compressible substance 1602 in order to inflate the chambers to a desired pressure level.

Air is also pumped into tube 1622 from the first tee 1608 to the vent solenoid 1612, which acts as a valve; however, during the "pumping" of the compressor 1618, the vent solenoid 1612 is closed such that the air will not be allowed to flow through the vent solenoid 1612. The vent solenoid 1612 is controlled via signals sent through wire 1636.

Furthermore, air is forced against the port of the pressure transducer 1616 through tube 1628 of the second tee. The pressure transducer 1616 of the compressor/pressure transducer module 1606 is a transducer that produces a signal, such as a voltage proportional to the pressure applied to its port. The pressure transducer 1616 is used during inflation to determine when the desired pressure (e.g. desired psi) within the compressible substance 1602 has been reached. Wire 1638 of the pressure transducer 1616 transmits the voltage signals proportional to the pressure within tube 1628 to the controlling computer (to translate the signals into estimation of pressure) through the interface port 1644 and the computer interface cable 1646. Such information is used to control the switching on and off of the compressor 1618. The compressor 1618 is well known in the art as described with reference to FIG. 6.

Once the pressure within the chambers of the compressible substance 1602 is at the desired level, i.e. the pressure at the pressure transducer 1616 is at the desired level, the pump solenoid 1610 is closed and the user squeezes the compressible substance 1602, which forces air back into the first tube 1604 and causes more pressure to be placed upon the pressure transducer 1616. Thus, the pressure transducer 1616 sends voltage signals which are proportional to the additional pressure within the system, which can be translated, by the controller of FIG. 10 for example, into the pressure or force exerted by the digits of the hand (e.g. by taking the difference between the initial pressure and the additional pressure), either collectively, or individually, depending on the embodiment. There is typically a direct proportionality between the force or pressure applied by the fingers and the measurements of the pressure transducer; however, this proportionality may be altered by different configurations and different material selection.

Additionally, the vent solenoid 1612 may be employed to vent the system; thus, allowing rapid deflation of the compressible substance 1602 upon completion of the therapy. In this case, the vent solenoid 1612 is opened, while the pump solenoid 1614 is closed. Thus, the air contained within the compressible substance 1602 and the system will be pushed out through tube 1622, through the vent solenoid 1612, through tube 1624, and out of the compressor/transducer module 1606 through filter 1620.

The compressor/pressure transducer module 1606 may be as shown, i.e. as a separate unit not physically located on the body of the diagnostic glove. Thus, the compressor/pressure transducer module 1606 may be worn on the body of the user (e.g. on the user's belt) or placed nearby the user and attached to the compressible substance 1602 via the first tube 1604. Alternatively, the compressor/pressure transducer module 1606 may be integrated onto the body of the diagnostic glove, as described above with reference to FIG. 6. The components of such a module are well known in the art; thus, no further explanation is required. Furthermore, the compressor/pressure transducer module 1606 may be easily modified to pump fluids or other gases into the compressible substance 1602 by attaching gas canisters or fluid reservoirs at the locations of the filters 1620 and 1621, for example.

Furthermore, for a compressible substance 1602 including more than one chamber, e.g. one chamber for each finger, there are five separate pressure transducers 1616 within five separate compressor/pressure transducer modules 1606. Thus, there is one compressor/pressure transducer module 1606 for each respective chamber of the compressible substance 1602. Alternatively, there may be one compressor/pressure transducer module, including 5 pressure transducers all sharing the same compressor and/or sharing common vent solenoids. The skilled artist could easily alter the basic design in a number of ways in which the five pressure transducers might share the vent solenoids, pump solenoids, or the various tubing.

While the invention herein disclosed has been described by means of specific embodiments and applications thereof, numerous modifications and variations could be made thereto by those skilled in the art without departing from the scope of the invention set forth in the claims.

What is claimed is:

1. A hand exercise device comprising:

a glove for receiving a band, the glove comprising:

a palm portion;

one or more finger portions, each for receiving a finger;

a compressible substance coupled to said palm portion, wherein said compressible substance is a generally spheroid shaped substance; and one or more extensible elastic members spanning from respective ones of said one or more finger portions to said compressible substance.

2. The device of claim 1 wherein said one or more elastic members, said palm portion, and said one or more finger portions form a single unit of a molded material.

3. The device of claim 2 wherein said molded material comprises latex.

4. The device of claim 1 wherein said one or more exible elastic members comprise one or more extensible elastic webs.

5. The device of claim 1 wherein said one or more extensible elastic members comprise one or more extensible elastic bands.

6. The device of claim 1 wherein said one or more extensible elastic members comprise a plurality of extensible elastic members, wherein respective ones of said plurality of extensible elastic members have differing elastic characteristics, whereby more or less resistance is applied to individual fingers during opening of said hand.

7. The device of claim 1 further comprising a pocket formed in said palm portion, wherein the pocket contains said compressible substance, wherein said each of said one or more extensible elastic members spans from said respective ones of said one or more finger portions to the pocket.

8. The device of claim 1 wherein said compressible substance includes one or more slits formed therein, wherein each of the one or more slits extends through said compressible substance, wherein said each of said one or more elastic members spans from said respective ones of said one or more finger portions to said compressible substance while extending through a respective one of the one or more slits.

9. The device of claim 1 wherein said compressible substance comprises an air-filled flexible capsule.

10. The device of claim 1 further comprising one or more chambers located within said compressible substance.

11. The device of claim 10 wherein said one or more chambers contains a material, wherein the material is selected from a group consisting of a gas, a fluid, and a gel.

12. The device of claim 10 wherein said one or more chambers are positioned within said compressible substance so as to be aligned with one or more fingers of the hand upon the closing of the hand.

13. The device of claim 10 further comprising one or more tubes, each having two ends, wherein respective ones of the one or more tubes extend into respective ones of said one or more chambers at one end and extend outward from said compressible substance at another end.

14. The device of claim 13 further comprising a compressor coupled to said other end of the respective ones of the one or more tubes.

15. The device of claim 13 further comprising a pressure transducer coupled to said other end of the respective ones of the one or more tubes.

16. The device of claim 15 further comprising a computer interface coupled to said pressure transducer.

17. The device of claim 1 further comprising a medication coating a portion of an interior surface of said glove, whereby the opening and closing action of the hand and heat generated during use increase the absorption of the medication into the skin of the hand, whereby facilitating a synergistic improvement of therapy.

18. The device of claim 17 wherein said medication further comprises a penetration enhancing agent, whereby the penetration enhancing agent has properties that further enhance the absorption of the medication into the skin of the hand.

19. The device of claim 1 further comprising a displacement transducer module coupled to said glove, wherein the displacement transducer module measures the displacent of individual digits during the opening and closing motion of the hand.

20. The device of claim 19 further comprising:

one or more lines extending from said displacement transducer module to a distal end of respective ones of said one or more finger portions, wherein said one or more lines are rigidly attached at the distal end of the respective ones of said one or more finger portions.

21. The device of claim 20 further comprising one or more line guides, positioned along a path taken by respective ones of said one or more lines between said displacement transducer module and said distal end of said respective ones of said one or more finger portions, wherein respective ones of said one or more lines are guided along the path by the one or more line guides.

22. The device of claim 21 wherein each of said one or more line guides has a hole extending therethrough for receiving said respective ones of said one or more lines.

23. The device of claim 19 further comprising a computer interface coupled to the displacement transducer module.

24. The device of claim 1 further comprising a thermal transducer coppled to said glove, wherein the thermal transducer measures changes in the temperature of the skin of the hand during use of the device.

25. The device of claim 24 wherein said thermal transducer is coupled to a computer interface.

26. The device of claim 1 wherein said one or more elastic members span from said compressible substance to a fingerprint portion of said respective ones of said one or more finger portions.

27. The device of claim 1 wherein each extensible elastic member is extensible along a path of an opening motion of respective finger relative to the palm portion.

28. A hand exercise device comprising:

a glove for receiving a hand including:

a palm portion;

one or more finger portions, each for the receiving a finger;

a compressible substance coupled to the palm portion; and one or more extensible elastic each having one end coupled to the compressible substance, said one or more extensible elactic members spanning from the compressible substance to respective ones of the one or more finger portions and spanning along each of the one or more finger portions to the compressible substance.

29. The device of claim 28 further comprising one or more chambers formed within the compressible substance.

30. The device of claim 29 further comprising a material contained within said one or more chambers, the material selected from the group consisting of a gas, a fluid, and a gel.

31. The device of claim 28 wherein said one or more elastic members, said palm portion, said one or more finger portions, and said compressible substance form a single unit of a molded material.

32. The device of claim 28 wherein said one or more extensible elastic members comprise one or more extensible elastic webs.

33. The device of claim 32 wherein each of said one or more extensible elastic webs couples to a respective finger portion from the base of the respective finger portion along a length to a respective finger portion.

34. The device of claim 28 wherein said one or more extensible elastic members comprise one or more extensible elastic bands.

35. The device of claim 28 wherein each of said one or more extensible elastic members folds upon itself when a respective finger portion moves from an open position to a closed position.

36. The device of claim 28 wherein the compressible substance comprises a generally spheriod substance.

37. The device of claim 28 wherein each extensible elastic member is extensible along a path of an opening motion of a respective finger relative to the palm portion.

38. A method of making a hand exercise device comprising:

forming a glove including a palm portion, one or more finger portions each for receiving a finger;

forming a compressible substance, wherein the compressible substance is a generally spheroid shaped substance;

coupling the compressible substance to the palm portion;

forming one or more extensible elastic members; and spanning and coupling the respective ones of the one or more extensible elastic members from the compressible substance to respective ones of one or more finger portions.

39. The method of claim 38 wherein said coupling said compressible substance comprises attaching said compressible substance to said palm portion with an adhesive.

40. The method of claim 38 wherein said coupling said compressible substance comprises stitching said compressible substance to said palm portion.

41. The method of claim 38 wherein said coupling said compressible substance comprises inserting said compressible substance into a pocket formed within said palm portion.

42. The method of claim 38 wherein said forming said glove further comprises forming said glove including said palm portion, said one or more finger portions, said compressible substance and said one or more extensible elastic members into a single unit of molded material, wherein said compressible substance is coupled to the palm portion and said respective ones of said one or more extensible elastic members ar spanned from said compressible substance to said respective ones of said one or more finger portions.

43. The device of claim 38 wherein said spanning comprises spanning and coupling said respective ones of said one or more elastic members from said palm portion to said respective ones of said one or more finger portions while extending through respective slits in said compressible substance.

44. A hand exercise device comprising:

a glove for receiving a hand including:

a palm portion;

a plurality of finger portions, each for receiving a finger and each having a front surface, a dorsal surface, and a base;

a compressible substance positionally fixed relative to the palm portion, wherein said compressible substance is generally spheroid shaped substance; and a respective extensible elastic member coupled to and spanning from the compressible substance to a first portion of each of the plurality of finger portions, and spanning along the front surface of each of the plurality of finger portions from the base of each of the plurality of the finger portions to the first portion of each of the plurality of finger portions, the respective extensible elastic member being extensible along a path of an opening motion of a respective finger relative to the palm portion.

* * * * *

UNITED STATES PATENT AND TRADEMARK OFFICE

CERTIFICATE OF CORRECTION

PATENT NO. : 6,454,681 B1
APPLICATION NO. : 09/475793
DATED : September 24, 2002
INVENTOR(S) : Thomas Brassil and John M. Brassil It is certified that error appears in the above-identified patent and that said Letters Patent is hereby corrected as shown below:

| Claim | Column | Line | Correction |
|---|---|---|---|
| 1 | 24 | 3 | Change "band" to "hand" |
| 4 | 24 | 17 | Change "exible to "extensible" |
| 24 | 25 | 33 | Change "coppled" to "coupled" |
| 27 | 25 | 44 | Before "respective" insert "a" |
| 28 | 25 | 52 | After "elastic" insert "members" |
| 28 | 25 | 54 | Change "elactic" to "elastic" |
| 33 | 26 | 6 | Change "from the" to "from a" |
| 33 | 26 | 7 | After "to a" insert "portion of the" |
| 44 | 26 | 65 | Before "generally" insert "a" |
| 44 | 27 | 4 | Before "finger" delete "the" |

Signed and Sealed this

Fifth Day of December, 2006

Jon W. Dudas

JON W. DUDAS
*Director of the United States Patent and Trademark Office*